US012753936B2

(12) United States Patent
Yajima

(10) Patent No.: US 12,753,936 B2
(45) Date of Patent: Oct. 6, 2026

(54) COMBUSTION HEATER AND AIR CONDITIONING SYSTEM

(71) Applicant: DAIKIN INDUSTRIES, LTD., Osaka (JP)

(72) Inventor: Ryuuzaburou Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 171 days.

(21) Appl. No.: 18/732,748

(22) Filed: Jun. 4, 2024

(65) Prior Publication Data

US 2024/0318840 A1 Sep. 26, 2024

Related U.S. Application Data

(62) Division of application No. 17/418,736, filed as application No. PCT/JP2019/050070 on Dec. 20, 2019, now Pat. No. 12,038,197.

(30) Foreign Application Priority Data

Dec. 28, 2018 (JP) ..... 2018-247676

(51) Int. Cl.
*F24F 3/044* (2006.01)
*F23D 14/14* (2006.01)
*F25B 49/00* (2006.01)

(52) U.S. Cl.
CPC ..... *F24F 3/044* (2013.01); *F23D 14/145* (2013.01); *F25B 49/005* (2013.01)

(58) Field of Classification Search
CPC .... F24H 3/00; F24D 5/00; F24F 13/02; F24F 11/67; F24F 11/36; F24F 11/89;
(Continued)

(56) References Cited

U.S. PATENT DOCUMENTS 4,143,707 A 3/1979 Lewis et al.
4,373,662 A 2/1983 Bassett et al.
(Continued)

FOREIGN PATENT DOCUMENTS

ES 2201989 T3 * 4/2004 ..... F01N 3/035
JP S62280525 A 12/1987
(Continued)

OTHER PUBLICATIONS

English translation of International Preliminary Report on Patentability and Written Opinion of the International Searching Authority for International Application No. PCT/JP2019/050070, dated Jul. 8, 2021.

(Continued)

*Primary Examiner* — Nelson J Nieves
(74) *Attorney, Agent, or Firm* — Birch, Stewart, Kolasch & Birch, LLP

(57) ABSTRACT

A combustion heater generates heat by means of flame. The combustion heater is disposed adjacent to a refrigerant circuit filled with a combustible refrigerant. The combustion heater includes a combustion unit and a porous body. The combustion unit causes generation of flame. The porous body covers the combustion unit or a periphery of the combustion unit. The porous body at least partially covers both or one of a combustion space receiving combustible refrigerant leaking from the refrigerant circuit and a member in contact with the combustible refrigerant leaking from the refrigerant circuit. The porous body has a plurality of holes. The holes have a diameter d1 equal to or less than an extinction diameter d of the combustible refrigerant.

3 Claims, 20 Drawing Sheets

(58) Field of Classification Search
CPC ... F24F 2221/54; F24F 2110/12; F25B 30/02; F25B 49/005; F23D 14/145
See application file for complete search history.

(56) References Cited

U.S. PATENT DOCUMENTS

| | | | | |
|---|---|---|---|---|
| 4,762,488 | A * | 8/1988 | Schilling | F23D 14/76 431/353 |
| 4,906,178 | A * | 3/1990 | Goldstein | F23N 1/022 126/116 A |
| 5,408,984 | A * | 4/1995 | Maughan | F23D 14/74 126/39 D |
| 5,470,222 | A * | 11/1995 | Holowczak | C04B 38/00 431/328 |
| 6,986,469 | B2 | 1/2006 | Gauthier et al. | |
| 7,293,718 | B2 | 11/2007 | Sigafus et al. | |
| 8,545,214 | B2 | 10/2013 | Chian et al. | |
| 8,876,524 | B2 | 11/2014 | Schultz et al. | |
| 9,032,950 | B2 | 5/2015 | Schultz | |
| 9,188,362 | B2 * | 11/2015 | Potter, Sr. | F24H 9/2085 |
| 9,261,277 | B2 | 2/2016 | Hugghins et al. | |
| 9,709,265 | B2 * | 7/2017 | Sutherland | F23D 14/16 |
| 9,927,132 | B2 | 3/2018 | Moriwaki et al. | |
| 10,036,571 | B1 * | 7/2018 | Gove | F24H 3/0488 |
| 10,386,078 | B2 | 8/2019 | Yoh et al. | |
| 10,982,862 | B1 | 4/2021 | Kaiser | |
| 2005/0150238 | A1 | 7/2005 | Helt | |
| 2006/0019208 | A1 * | 1/2006 | Lin | F24H 3/0488 431/153 |
| 2007/0040040 | A1 | 2/2007 | Mueller | |
| 2008/0277488 | A1 | 11/2008 | Cockerill | |
| 2010/0006660 | A1 | 1/2010 | Leen et al. | |
| 2012/0248207 | A1 | 10/2012 | Drake et al. | |
| 2013/0213068 | A1 | 8/2013 | Goel et al. | |
| 2015/0219342 | A1 * | 8/2015 | Yoh | F24H 15/258 126/116 A |
| 2016/0334115 | A1 * | 11/2016 | Kojima | F24H 15/38 |
| 2016/0363358 | A1 | 12/2016 | Papas et al. | |
| 2018/0231260 | A1 * | 8/2018 | Wilson | G08B 21/182 |
| 2019/0170114 | A1 | 6/2019 | McQuade | |
| 2020/0132321 | A1 | 4/2020 | Blanton | |
| 2021/0318012 | A1 | 10/2021 | Yamada et al. | |

FOREIGN PATENT DOCUMENTS

| | | | | |
|---|---|---|---|---|
| JP | 2000-249367 | A | 9/2000 | |
| JP | 2006183977 | A * | 7/2006 | |
| WO | WO-9920946 | A1 * | 4/1999 | F24F 5/00 |

OTHER PUBLICATIONS

International Search Report for PCT/JP2019/050070 mailed on Feb. 25, 2020.

* cited by examiner

| ASHRAE Number | Composition | (Mass%) | Alternative |
|---|---|---|---|
| R1234yf | R1234yf | (100) | R134a |
| R1234ze(E) | R1234ze(E) | (100) | R134a |
| | R1234yf/R134a/R152a | (82/7/11) | R134a |
| R516A | R1234yf/R134a/R152a | (77.5/8.5/14.0) | R134a |
| R445A | R744/R134a/R1234ze(E) | (6.0/9.0/85.0) | R134a |
| R444A | R32/R152a/R1234ze(E) | (12/5/83) | R134a |
| | R32/R125/R1234yf | (15/25/60) | R22/407 |
| R454C | R32/R1234yf | (21.5/78.5) | R22/407 |
| | R32/R152a/R1234ze(E) | (45/20/35) | R22/407 |
| R444B | R32/R152a/R1234ze(E) | (41.5/48.5/10) | R22/407 |
| | R744/R32/R1234ze(E) | (7/30/63) | R22/407 |
| R454A | R32/R1234yf | (35/65) | R404A |
| R454A | R32/R1234yf | (35/65) | R404A |
| R454C | R32/R1234yf | (21.5/78.5) | R404A |
| | R32/R1234yf/R152a/R1234ze(E) | (40/20/10/30) | R404A |
| R455A | R744/R32/R1234yf | (3.0/21.5/75.5) | R404A |
| | R32/R1234yf/R134a | (28/51/21) | R404A |
| | R32/R1234yf/R152a | (35/55/10) | R404A |
| | R32/R1234yf | (29/71) | R404A |
| | R-32/R290/R1234yf | (21.0/7.9/71.1) | R404A |
| R457A | R32/R1234yf/R152a | (18/70/12) | R404A |
| R459B | R32/R1234yf/R1234ze(E) | (21/69/10) | R404A |
| | R32/R134a | (50/50) | R404A |
| | R32/R1234yf | (40/60) | R410A |
| R452B | R32/R125/R1234yf | (67/7/26) | R410A |
| | R32/R1234yf | (72.5/27.5) | R410A |
| R454B | R32/R1234yf | (68.9/31.1) | R410A |
| | R32/R125/R1234ze(E) | (68/15/17) | R410A |
| R447B | R32/R125/R1234ze(E) | (68/8/24) | R410A |
| R32 | R32 | (100) | R410A |
| R447A | R32/R1234ze(E)/R125 | (68/28.5/3.5) | R410A |
| | R32/R1234yf/R1234ze(E) | (73/15/12) | R410A |
| | R32/R1234ze(E) | (72/27) | R410A |
| R446A | R32/R1234ze(E)/Butane | (68/29/3) | R410A |
| | R32/R1234yf/R134a | (50/40/10) | R410A |
| R459A | R32/R1234yf/R1234ze(E) | (68/26/6) | R410A |
| | R1123/R32 | (32/68) | R410A |
| | R1123/R32 | (40/60) | R410A |
| | R1123/R32 | (45/55) | R410A |
| | R1123/R32/R1234yf | (19/55/26) | R410A |
| | R1123/R32/R1234yf | (40/44/16) | R410A |
| | R1123 | (100) | R410A |
| | R744/R32/R1234ze(E) | (6/60/34) | R410A |
| | R32/R134a/R1234ze | (76/6/18) | R410A |
| | R32/R152a | (95/5) | R410A |
| | R32/R134a | (95/5) | R410A |

FIG. 7

| REFRIGERANT | COMBUSTION SPEED (cm/sec) |
|---|---|
| R32 | 6.7 |
| R1234yf | 1.5 |
| R452B | < 4.0 |
| R290 | 38.7 |
| R600a | 34.2 |

FIG. 15

COMBUSTION HEATER AND AIR CONDITIONING SYSTEM

This application is a Divisional of copending application Ser. No. 17/418,736, filed on Jun. 25, 2021, which is the National Phase under 35 U.S.C. § 371 of International Application No. PCT/JP2019/050070, filed on Dec. 20, 2019, which claims the benefit under 35 U.S.C. § 119(a) to Japanese Patent Application No. 2018-247676, filed on Dec. 28, 2018, all of which are hereby expressly incorporated by reference into the present application.

TECHNICAL FIELD

The present disclosure relates to a combustion heater or an air conditioning system.

BACKGROUND ART

There has been conventionally a combustion heater configured to generate heat by means of flame.

SUMMARY OF THE INVENTION

Technical Problem

It is an object of the present disclosure to improve security of a combustion heater.

Solution to Problem

A combustion heater according to a first aspect is configured to generate heat by means of flame. The combustion heater is disposed adjacent to a refrigerant circuit. The refrigerant circuit is filled with a combustible refrigerant. The combustion heater includes a combustion unit and a porous body. The combustion unit causes generation of flame. The porous body covers the combustion unit or a periphery of the combustion unit. The porous body at least partially covers both or one of a space receiving any combustible refrigerant leaking from the refrigerant circuit and a member in contact with any combustible refrigerant leaking from the refrigerant circuit. The porous body has a plurality of holes. The holes each have a diameter equal to or less than an extinction diameter of the combustible refrigerant.

The state of being "disposed adjacent to a refrigerant circuit" in this case indicates that the combustion heater is disposed close to the refrigerant circuit such that refrigerant leaking from the refrigerant circuit flows into or comes into contact with the combustion heater. Examples of the state of being "disposed adjacent to a refrigerant circuit" include a state where a single casing accommodates the combustion heater and at least part of the refrigerant circuit, and a state where the combustion heater is disposed in a periphery of the refrigerant circuit accommodated in a different casing.

The element "combustion unit" in this case corresponds to at least one of a part configured to cause generation of flame, a part providing a space for generation of flame, and a part providing a space for propagation of flame.

Examples of the site "a periphery of the combustion unit" in this case include at least one of a space for generation of flame, a portion in contact with flame, and a portion or a space increased in temperature to cause ignition of the combustible refrigerant through direct or indirect influence of heat generated at the combustion unit, which are vicinities of the combustion unit.

Examples of the "combustible refrigerant" in this case include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants-Designation and safety classification.

The "extinction diameter" in this case corresponds a diameter of a hole restraining passage of flame generated by combustion of the combustible refrigerant. Examples of the extinction diameter include a hole diameter enough to restrain propagation of flame generated upon ignition of the combustible refrigerant due to flame, heat, or the like at the combustion unit or in the periphery of the combustion unit.

A combustion heater according to a second aspect is configured to generate heat by means of flame. The combustion heater is disposed adjacent to a refrigerant circuit. The refrigerant circuit is filled with a combustible refrigerant. The combustion heater includes a combustion unit and a flow path forming member. The combustion unit causes generation of flame. The flow path forming member forms a flow path for gas having passed through the combustion unit. Gas flow speed at least in one of the combustion unit, a periphery of the combustion unit, and an inlet of the flow path forming member is higher than combustion speed of the combustible refrigerant.

The state of being "disposed adjacent to a refrigerant circuit" in this case indicates that the combustion heater is disposed close to the refrigerant circuit such that refrigerant leaking from the refrigerant circuit flows into or comes into contact with the combustion heater. Examples of the state of being "disposed adjacent to a refrigerant circuit" include a state where a single casing accommodates the combustion heater and at least part of the refrigerant circuit, and a state where the combustion heater is disposed in a periphery of the refrigerant circuit accommodated in a different casing.

The element "combustion unit" in this case corresponds to at least one of a part configured to cause generation of flame, a part providing a space for generation of flame, and a part providing a space for propagation of flame.

Examples of the site "a periphery of the combustion unit" in this case include at least one of a space for generation of flame, a portion in contact with flame, and a portion or a space increased in temperature to cause ignition of the combustible refrigerant through direct or indirect influence of heat generated at the combustion unit, which are vicinities of the combustion unit.

Examples of the "combustible refrigerant" in this case include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants—Designation and safety classification.

The "gas" in this case is at least one of fuel gas, air mixed with fuel gas, mixed gas of fuel gas and air, and combustion gas generated by combustion of the mixed gas.

The "gas" has flow speed at least higher than combustion speed of the combustible refrigerant in a direction opposite by 180 degrees from a propagation direction of flame generated at the combustion unit.

A combustion heater according to a third aspect is configured to generate heat by means of flame. The combustion heater is disposed adjacent to a refrigerant circuit. The refrigerant circuit is filled with a combustible refrigerant. The combustion heater includes a combustion unit and a heat insulator. The combustion unit causes generation of flame. The heat insulator at least partially covers a member disposed at the combustion unit or in the periphery of the combustion unit and disposed at a position in contact with combustible refrigerant leaking from the refrigerant circuit.

The state of being "disposed adjacent to a refrigerant circuit" in this case indicates that the combustion heater is disposed close to the refrigerant circuit such that refrigerant leaking from the refrigerant circuit flows into or comes into contact with the combustion heater. Examples of the state of being "disposed adjacent to a refrigerant circuit" include a state where a single casing accommodates the combustion heater and at least part of the refrigerant circuit, or a state where the combustion heater is disposed in a periphery of the refrigerant circuit accommodated in a different casing.

The element "combustion unit" in this case corresponds to at least one of a part configured to cause generation of flame, a part providing a space for generation of flame, and a part providing a space for propagation of flame.

Examples of the site "a periphery of the combustion unit" in this case include at least one of a space for generation of flame, a portion in contact with flame, and a portion or a space increased in temperature to cause ignition of the combustible refrigerant through direct or indirect influence of heat generated at the combustion unit, which are vicinities of the combustion unit.

Examples of the "combustible refrigerant" in this case include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants-Designation and safety classification.

Examples of a "member disposed in the periphery of the combustion unit" in this case include a member constituting the combustion unit, a flow path forming member forming a flow path for gas having passed through the combustion unit, and a partition wall between the combustion unit and a heat exchange unit configured to heat a heating target by means of gas having passed through the combustion unit.

The "position in contact with combustible refrigerant leaking from the refrigerant circuit" in this case indicates a position in contact with refrigerant when refrigerant leaks from the refrigerant circuit.

A combustion heater according to a fourth aspect is the combustion heater according to the third aspect, in which the heat insulator covers a portion having at least 700 degrees Celsius during operation, of the member disposed at the combustion unit or in the periphery of the combustion unit and disposed at a position in contact with combustible refrigerant leaking from the refrigerant circuit.

A combustion heater according to a fifth aspect is the combustion heater according to the third or fourth aspect, and the combustion heater further includes a porous body. The porous body has a plurality of holes. The porous body covers the combustion unit or a periphery of the combustion unit. The porous body at least partially covers both or one of a space receiving combustible refrigerant leaking from the refrigerant circuit and a member in contact with combustible refrigerant leaking from the refrigerant circuit. The holes each have a diameter equal to or less than an extinction diameter of the combustible refrigerant.

The "extinction diameter" in this case corresponds a diameter of a hole restraining passage of flame generated by combustion of the combustible refrigerant. Examples of the extinction diameter include a hole diameter enough to restrain propagation of flame generated upon ignition of the combustible refrigerant due to flame, heat, or the like at the combustion unit or in the periphery of the combustion unit.

A combustion heater according to a sixth aspect is the combustion heater according to any one of the first and third to fifth aspects, and the combustion heater further includes a flow path forming member. The flow path forming member forms a flow path for gas having passed through the combustion unit. Gas flow speed at least in one of the combustion unit, a periphery of the combustion unit, and an inlet of the flow path forming member is higher than combustion speed of the combustible refrigerant.

The "gas" in this case is at least one of fuel gas, air mixed with fuel gas, mixed gas of fuel gas and air, and combustion gas generated by combustion of the mixed gas.

The "combustion speed" in this case indicates speed of the combustible refrigerant entering at right angle with respect to flame generated at the combustion unit.

An air conditioning system according to a seventh aspect includes a refrigeration apparatus and the combustion heater according to any one of the first to sixth aspects. The refrigeration apparatus includes a refrigerant circuit. The refrigerant circuit is filled with a combustible refrigerant. The combustion heater is disposed adjacent to the refrigeration apparatus.

BRIEF DESCRIPTION OF THE DRAWINGS

FIG. 7 is a chart indicating specific examples of a combustible refrigerant filled in a refrigerant circuit.

FIG. 15 is a pattern chart indicating combustion speed of exemplary combustible refrigerants.

DESCRIPTION OF EMBODIMENTS

Description will be made hereinafter to embodiments of the present disclosure. The following embodiments specifically exemplify the present disclosure without limiting the technical scope thereof, and can be appropriately modified within the range not departing from the purpose of the present disclosure.

Entire Configuration (1) Air Conditioning System 1

Figure 1:
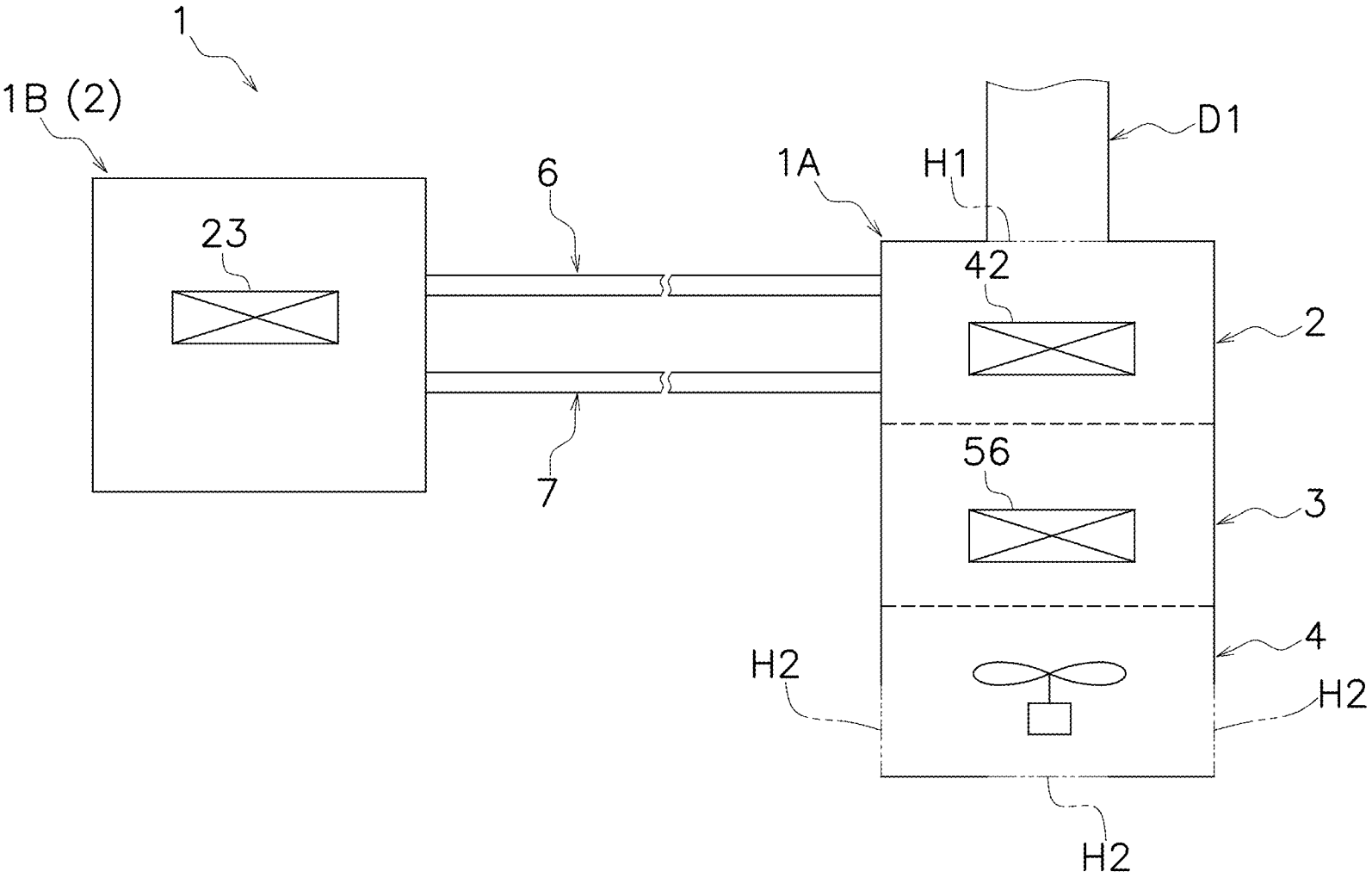
FIG. 1 is a pattern diagram schematically depicting an entire configuration of an air conditioning system.

FIG. 1 is a pattern diagram schematically depicting a configuration of the air conditioning system 1. The air conditioning system 1 principally includes a refrigeration apparatus 2 having a refrigerant circuit 20 (FIG. 5 and FIG. 6) filled with a combustible refrigerant, a combustion heater 3 configured to generate heat by means of flame, and a supplier fan 4 configured to send, to a room R1, air conditioned by the refrigeration apparatus 2 or the combustion heater 3.

The air conditioning system 1 includes a first unit 1A accommodating utilization devices of the refrigeration apparatus 2, the combustion heater 3, and the supplier fan 4, and a second unit 1B accommodating heat source devices of the refrigeration apparatus 2. The first unit 1A includes a utilization heat exchanger 42 of the refrigeration apparatus 2, a furnace heat exchanger 56 of the combustion heater 3, the supplier fan 4, and the like. The first unit 1A is provided with an opening (air outlet H1) allowing output of air. The air outlet H1 communicates with a first end of a duct D1. The first unit 1A is provided with an opening (air inlet H2) allowing introduction of air to be sucked to the supplier fan 4. The second unit 1B includes a heat source heat exchanger 23 of the refrigeration apparatus 2. One or both of the first unit 1A and the second unit 1B is provided with a microcomputer configured to control operation of each unit in the air conditioning system 1 and various electric components (not depicted).

In the air conditioning system 1, the first unit 1A, the second unit 1B, and refrigerant connection pipes 6 and 7 constitute the refrigerant circuit 20 of the refrigeration apparatus 2. The refrigeration apparatus 2 in operation achieves a vapor compression refrigeration cycle in the refrigerant circuit 20 to cool air to be sent to the duct D1. The combustion heater 3 heats air to be sent to the duct D1 by means of a heat source (specifically, heat generated through combustion of fuel) different from the heat source for the refrigeration apparatus 2.

Figure 2:
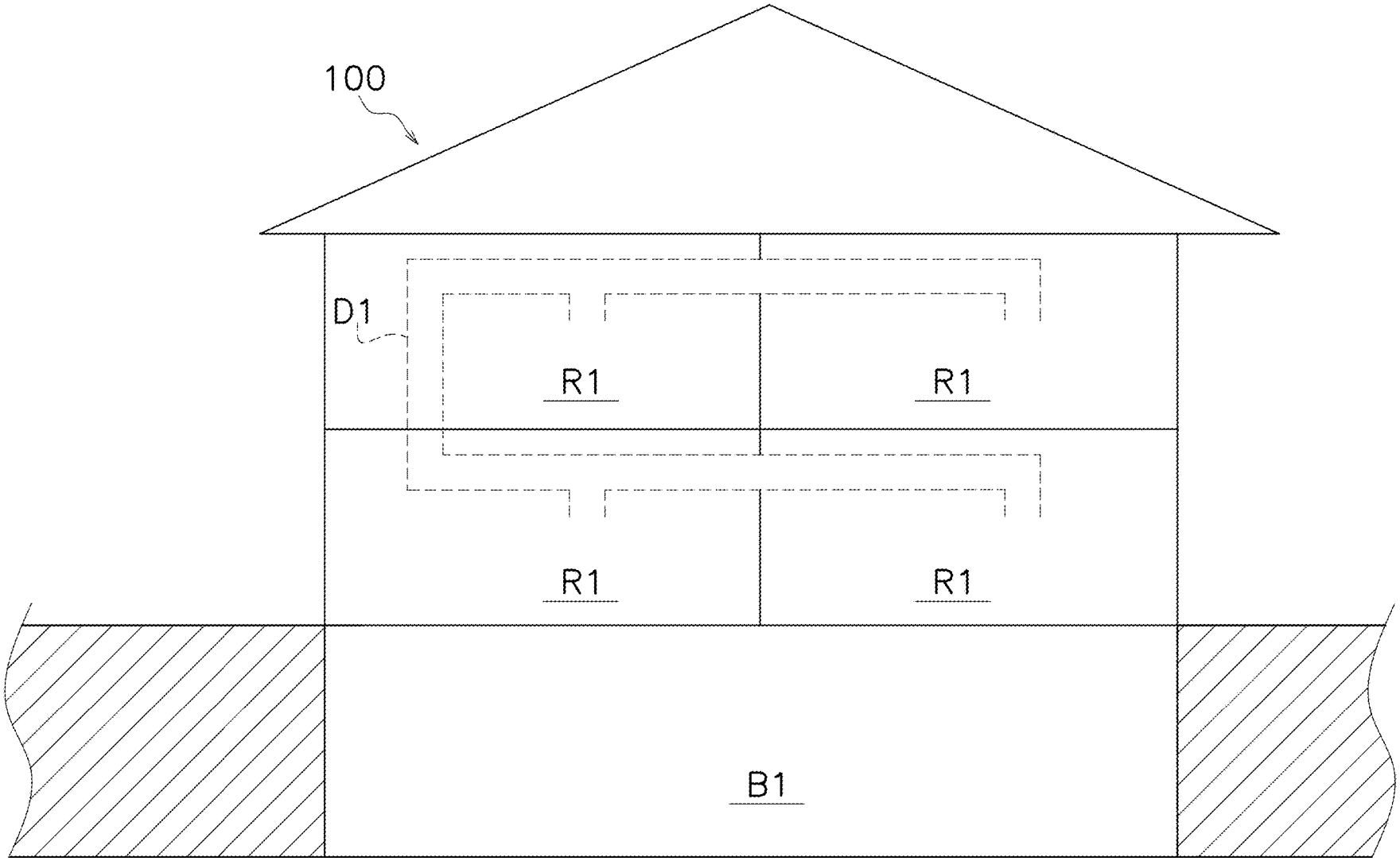
FIG. 2 is a pattern diagram of an exemplary house equipped with the air conditioning system.

FIG. 2 is a pattern diagram of an exemplary house 100 equipped with the air conditioning system 1. The air conditioning system 1 is used to condition air in a house or a building. Description is made herein to a case where the air conditioning system 1 is installed in the house 100 having two stories as depicted in FIG. 2. The house 100 has one or a plurality of rooms R1 on each floor. The house 100 also has a basement B1. The house, the building or the like equipped with the air conditioning system 1 is not limited to the exemplification in FIG. 2 in terms of the structure and the configuration mode, but can be modified appropriately. The house 100 is provided with the duct D1 causing air cooled by the air conditioning system 1 to be sent to the rooms R1. The first end of the duct D1 is connected to the air outlet H1 of the air conditioning system 1 installed in the house 100 (see FIG. 1). The duct D1 has a second end branched to communicate with the rooms R1. Though not depicted, each of the rooms R1 is provided with a ventilation duct.

Figure 3:
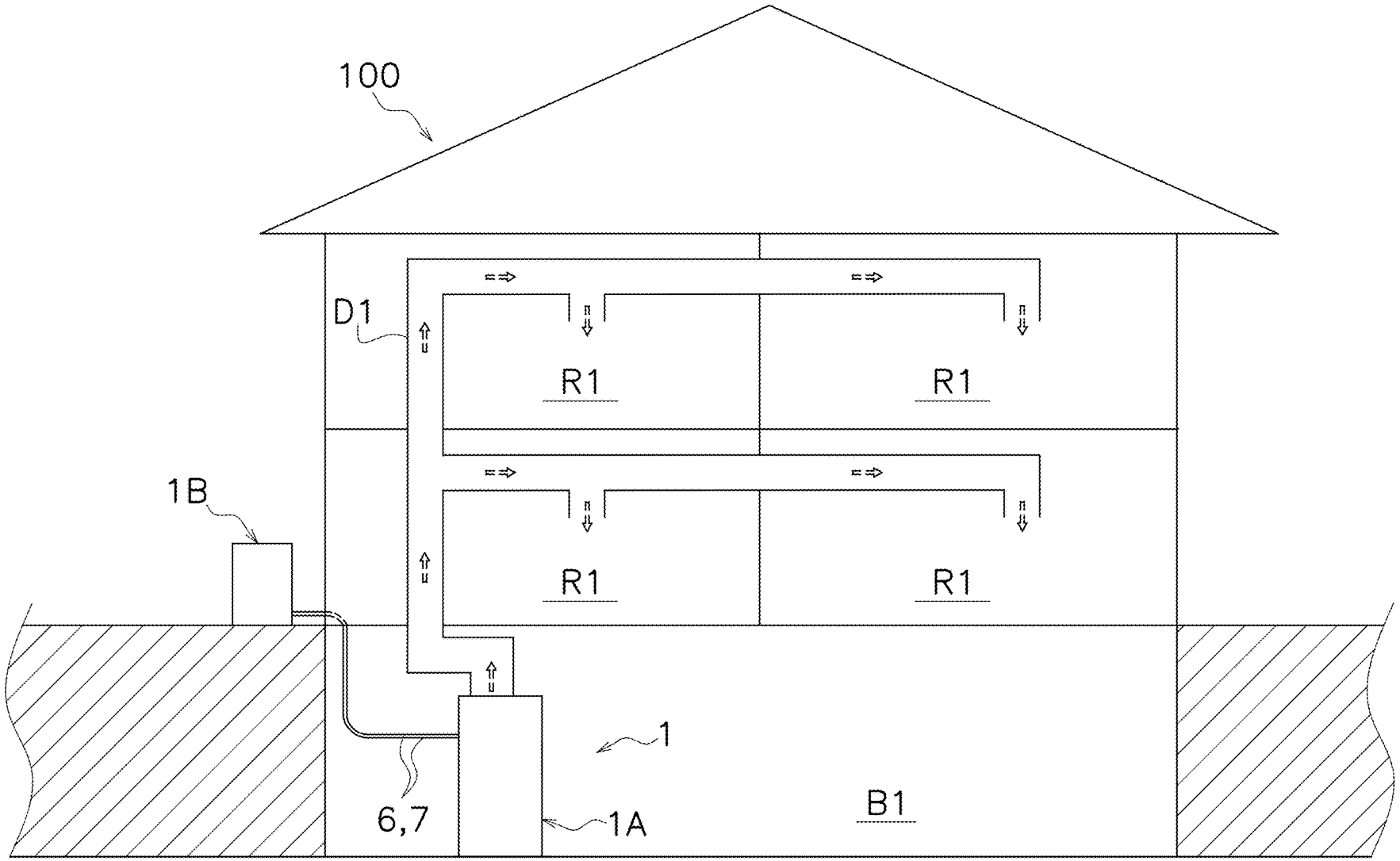
FIG. 3 is a pattern diagram of exemplary installation, in a house, of an air conditioning system of a duct split type.

The air conditioning system 1 is installed in the house 100 in a mode that can be modified appropriately in accordance with the configuration mode of the air conditioning system 1. In an exemplary case where the air conditioning system 1 is of a so-called duct split type, the air conditioning system 1 is installed in the house 100 in such a mode depicted in FIG. 3. The air conditioning system 1 of the duct split type includes the first unit 1A and the second unit 1B configured separately from each other. FIG. 3 depicts a state where the first unit 1A is installed in the basement B1, the second unit 1B is disposed outdoors, and the first unit 1A and the second unit 1B are connected to each other by the refrigerant connection pipes 6 and 7. FIG. 3 includes broken arrows indicating a flow direction of air sent from the air conditioning system 1 to the rooms R1 through the duct D1. In the case where the first unit 1A and the second unit 1B are configured separately from each other as in the air conditioning system 1 of the duct split type, the first unit 1A is not necessarily installed in the basement B1 but may alternatively be installed in any one of the remaining rooms R1 or be disposed outdoors, though not depicted.

Figure 4:
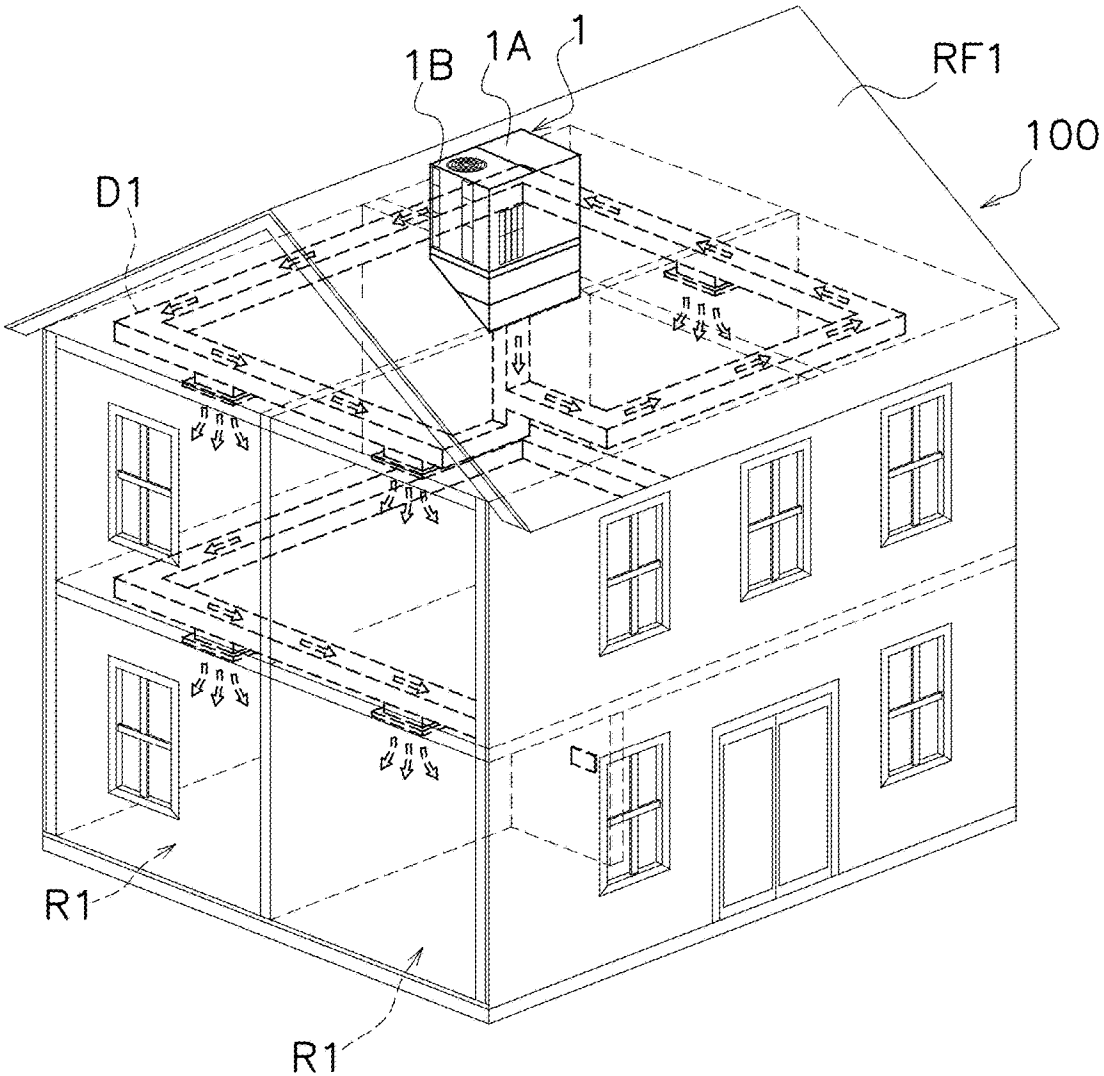
FIG. 4 is a pattern diagram of exemplary installation, in a house, of an air conditioning system of a rooftop type.

In another exemplary case where the air conditioning system 1 is of a so-called rooftop type, the air conditioning system 1 is installed in the house 100 in such a mode depicted in FIG. 4. The air conditioning system 1 of the rooftop type includes the first unit 1A and the second unit 1B configured integrally to be disposed on a roof. FIG. 4 depicts a state where the air conditioning system 1 including the first unit 1A and the second unit 1B configured integrally is disposed on a roof RF1 of the house 100. FIG. 4 includes broken arrows indicating a flow direction of air sent from the air conditioning system 1 to the rooms R1 through the duct D1. In the case where the first unit 1A and the second unit 1B are configured integrally as in the air conditioning system 1 of the rooftop type, the air conditioning system 1 is not necessarily disposed on the roof but may alternatively be disposed on a balcony or the ground, though not depicted.

The refrigeration apparatus 2 and the combustion heater 3 may alternatively be configured separately from each other. In other words, the refrigeration apparatus 2 and the combustion heater 3 may be accommodated in different casings to be disposed away from each other.

(1-1) Refrigeration Apparatus 2

Figure 5:
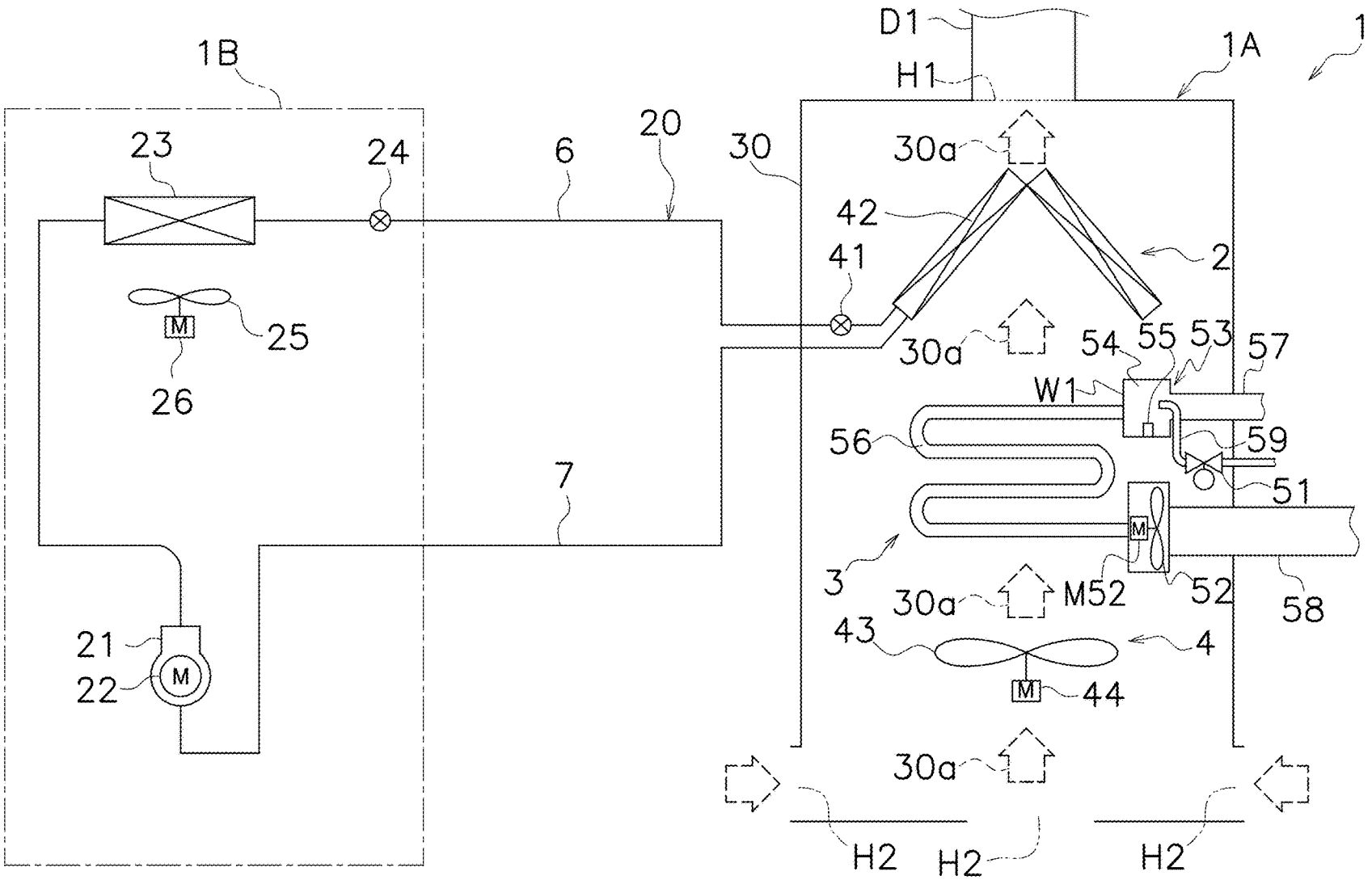
FIG. 5 is a pattern diagram of an exemplary configuration mode of the air conditioning system.
Figure 6:
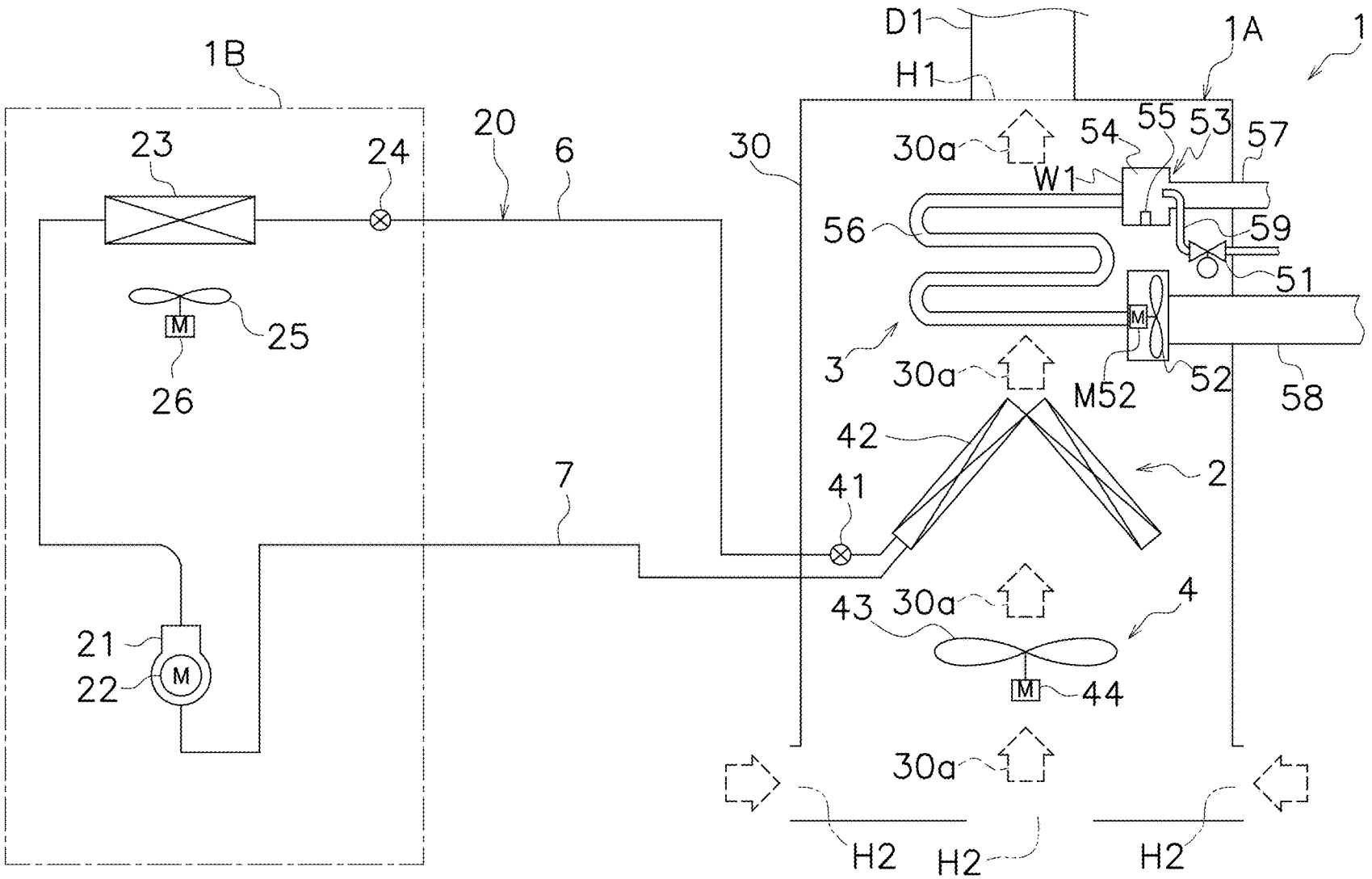
FIG. 6 is a pattern diagram of another exemplary configuration mode of the air conditioning system.

FIG. 5 and FIG. 6 are pattern diagrams of exemplary configuration modes of the air conditioning system 1. FIG. 5 and FIG. 6 each include broken arrows indicating a blast flow path 30*a* provided in a case 30 of the first unit 1A. The blast flow path 30*a* serves as a flow path for air flowing in through the air inlet H2 and flowing out through the air outlet H1, and extends from the air inlet H2 to the air outlet H1. In other words, the broken arrows in FIG. 5 and FIG. 6 indicate an air flow direction in a case where the supplier fan 4 is in operation. FIG. 5 and FIG. 6 are different from each other in that the utilization heat exchanger 42 of the refrigeration apparatus 2 and the furnace heat exchanger 56 of the combustion heater 3 are positionally replaced each other on the blast flow path 30*a*.

The refrigeration apparatus 2 includes the first unit 1A and the second unit 1B connected to each other by the refrigerant connection pipes 6 and 7. The refrigerant connection pipes 6 and 7 are refrigerant pipes constructed onsite when the air conditioning system 1 is installed. The refrigerant circuit 20 of the refrigeration apparatus 2 is constituted by the first unit 1A and the second unit 1B connected to each other via the refrigerant connection pipes 6 and 7.

The refrigerant filled in the refrigerant circuit 20 is the combustible refrigerant that can burn under a specific condition. Examples of the "combustible refrigerant" in this case include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants-Designation and safety classification. FIG. 7 indicates specific examples of the combustible refrigerant filled in the refrigerant circuit 20. FIG. 7 has a column "ASHRAE Number" indicating an ASHRAE number of each refrigerant prescribed by ISO 817, a column "Composition" indicating an ASHRAE number of each substance contained in each of the refrigerants, a column "Mass %" indicating a mass percent concentration of each of the substances contained in each of the refrigerants, and a column "Alternative" indicating a name of each substance in each of the refrigerants, which is often substituted by the refrigerant. The refrigerant filled in the refrigerant circuit 20 may alternatively be a combustible refrigerant not indicated in FIG. 7. For example, the refrigerant circuit 20 may be filled with a refrigerant such as HFC254fb or R717.

The first unit 1A constitutes part of the refrigerant circuit 20 in the refrigeration apparatus 2. In the first unit 1A, the refrigeration apparatus 2 principally includes a utilization expansion valve 41 and the utilization heat exchanger 42.

The utilization expansion valve 41 is configured to decompress a refrigerant circulating in the refrigerant circuit 20 and adjust a flow rate of a refrigerant flowing in the utilization heat exchanger 42. Examples of the utilization expansion valve 41 include an electronic expansion valve having an electrically controllable opening degree. The utilization expansion valve 41 may alternatively be a temperature sensitive expansion valve including a temperature sensitive cylinder.

During heat pump cooling operation (to be described later), the utilization heat exchanger 42 cools air by means of evaporation of the refrigerant in the refrigeration cycle. The utilization heat exchanger 42 is disposed on the blast flow path 30*a* provided in the case 30 of the first unit 1A.

The utilization heat exchanger 42 has a disposition mode on the blast flow path 30*a* that can be modified appropriately in accordance with design specification and installation environment. The utilization heat exchanger 42 depicted in FIG. 5 is disposed leeward of the furnace heat exchanger 56 on the blast flow path 30*a*. The utilization heat exchanger 42 depicted in FIG. 6 is disposed windward of the furnace heat exchanger 56 on the blast flow path 30*a*.

The second unit 1B constitutes part of the refrigerant circuit 20 in the refrigeration apparatus 2. The second unit 1B principally includes a compressor 21, the heat source heat exchanger 23, and a heat source expansion valve 24.

The compressor 21 includes a compression element (not depicted) configured to compress a refrigerant, and a compressor motor 22 configured to rotationally drive the compression element.

The heat source heat exchanger 23 is configured to condense a refrigerant in the refrigeration cycle by means of outdoor air during heat pump cooling operation. The heat source heat exchanger 23 is provided nearby with a heat source fan 25 configured to send outdoor air to the heat source heat exchanger 23. The heat source fan 25 is rotationally driven by a heat source fan motor 26.

The heat source expansion valve 24 is configured to decompress a refrigerant circulating in the refrigerant circuit 20 before the refrigerant is sent to the heat source heat exchanger 23 during heat pump cooling operation. The heat source expansion valve 24 may alternatively be a temperature sensitive expansion valve including a temperature sensitive cylinder.

The second unit 1B is further provided with an outdoor temperature sensor configured to detect outdoor air temperature, and the like.

The air conditioning system 1 may alternatively be configured to execute heat pump heating operation in addition to heat pump cooling operation. In other words, the air conditioning system 1 may be configured to be switched between heat pump cooling operation and heat pump heating operation. In such a case, a four-way switching valve or the like may be disposed and be controlled in terms of a state thereof to witchingly invert a refrigerant flow in the refrigerant circuit 20 between heat pump cooling operation and heat pump heating operation. In this case, switching between heat pump heating operation and furnace heating operation is executed in accordance with an environmental condition such as outdoor air temperature or temperature in the room R1, or a command inputted by a user.

(1-2) Combustion Heater 3

The combustion heater 3 is provided in the case 30 of the first unit 1A. The combustion heater 3 is disposed adjacent to the refrigerant circuit 20. The combustion heater 3 functions as a gas combustion heating apparatus in this case. Examples of fuel gas adopted in the combustion heater 3 include natural gas and petroleum gas.

The combustion heater 3 principally includes a fuel gas valve 51, a furnace fan 52, a combustion unit 53, the furnace heat exchanger 56, an air supply pipe 57, and an air exhaust pipe 58.

The fuel gas valve 51 includes an electromagnetic valve or the like configured to be controlled to open and close, and is provided on a fuel gas supply pipe 59 extending from the outside of the case 30 to the combustion unit 53.

The furnace fan 52 is configured to generate an air flow by introducing air from the air supply pipe 57 or the like into the combustion unit 53, sending the air to the furnace heat exchanger 56, and discharging the air from the air exhaust pipe 58. The furnace fan 52 is rotationally driven by a furnace fan motor M52.

The combustion unit 53 corresponds to a part causing generation of flame, a part providing a space for generation of flame, and a part providing a space for propagation of flame. In other words, the combustion unit 53 in operation causes generation of flame. The combustion unit 53 includes a burner unit 54 and an ignition unit 55. The burner unit 54 is configured to burn mixed gas of fuel gas and air to obtain combustion gas having high temperature. The burner unit 54 is separated from the blast flow path 30*a* by a partition wall W1. The ignition unit 55 is provided at the burner unit 54. The ignition unit 55 has an igniter including a heater, a spark plug, or the like, and ignites mixed gas in the burner unit 54.

The furnace heat exchanger 56 is configured to heat air by means of heat radiation of combustion gas obtained at the combustion unit 53. The furnace heat exchanger 56 depicted in FIG. 5 is disposed windward of the utilization heat exchanger 42 on the blast flow path 30*a*. The furnace heat exchanger 56 depicted in FIG. 6 is disposed leeward of the utilization heat exchanger 42 on the blast flow path 30*a*.

The combustion heater 3 will be described later in terms of its more detailed configuration.

(1-3) Supplier Fan

The supplier fan 4 is configured to send, to the rooms R1, air heated by the utilization heat exchanger 42 of the refrigeration apparatus 2 or the furnace heat exchanger 56 of the combustion heater 3. FIG. 5 and FIG. 6 each depict the supplier fan 4 disposed windward of the utilization heat exchanger 42 and the furnace heat exchanger 56 on the blast flow path 30*a*. The supplier fan 4 may alternatively be disposed leeward of one or both of the utilization heat exchanger 42 and the furnace heat exchanger 56. The supplier fan 4 includes a fan 43 and a fan motor 44 configured to rotationally drive the fan 43. Examples of the fan 43 include a sirocco fan and a turbo fan.

(2) Operation

The air conditioning system 1 appropriately controls operation of the refrigeration apparatus 2 and the combustion heater 3 in accordance with a command inputted by a user to achieve heating operation or cooling operation. Cooling operation by the air conditioning system 1 includes heat pump cooling operation of cooling air in the rooms R1 with use of the refrigeration apparatus 2. Heating operation includes furnace heating operation of heating air in the rooms R1 with use of the combustion heater 3.

(2-1) Heat Pump Cooling Operation

During heat pump cooling operation, the refrigerant in the refrigerant circuit 20 is sucked into the compressor 21 to be compressed into a high-pressure gas refrigerant. The refrigerant compressed in the compressor 21 is sent to the heat source heat exchanger 23. The refrigerant sent to the heat source heat exchanger 23 exchanges heat with outdoor air supplied by the heat source fan 25 to achieve condensation or heat radiation in the heat source heat exchanger 23. The refrigerant flowing out of the heat source heat exchanger 23 is decompressed by the heat source expansion valve 24 and is then sent from the second unit 1B to the first unit 1A via the liquid-refrigerant connection pipe 6.

The refrigerant sent to the first unit 1A is sent to the utilization heat exchanger 42. The refrigerant sent to the utilization heat exchanger 42 exchanges heat with air flowing in the blast flow path 30*a* by the supplier fan 4 to evaporate in the utilization heat exchanger 42. The refrigerant evaporated in the utilization heat exchanger 42 is sent from the first unit 1A to the second unit 1B via the gas-refrigerant connection pipe 7. Air cooled in the utilization heat exchanger 42 leaves the blast flow path 30*a* and is sent from the first unit 1A to the rooms R1 via the duct D1 to achieve cooling operation.

The refrigerant sent to the second unit 1B is sucked again into the compressor 21.

(2-2) Furnace Heating Operation

During furnace heating operation, the fuel gas valve 51 is opened to supply fuel gas to the combustion unit 53. In the burner unit 54, the furnace fan 52 operates to mix air introduced from the air supply pipe 57 to the combustion heater 3 with fuel gas supplied from the fuel gas supply pipe 59. Mixed gas thus obtained is ignited by the ignition unit 55 to burn. This leads to generation of combustion gas having high temperature.

The combustion gas generated in the combustion unit 53 is sent to the furnace heat exchanger 56. The combustion gas sent to the furnace heat exchanger 56 exchanges heat with air flowing in the blast flow path 30*a* by the supplier fan 4 to be cooled in the furnace heat exchanger 56. The combustion gas cooled in the furnace heat exchanger 56 is discharged from the combustion heater 3 and the first unit 1A through the air exhaust pipe 58. Air heated in the furnace heat exchanger 56 leaves the blast flow path 30*a* and is sent to the rooms R1 via the duct D1.

Details of Combustion Heater 3

The combustion heater 3 is disposed adjacent to the refrigerant circuit 20. In other words, the combustion heater 3 is disposed close to the refrigerant circuit 20 such that any refrigerant leaking from the refrigerant circuit 20 flows into or comes into contact with the combustion heater 3. In connection with this, the combustion heater 3 is configured to improve security against refrigerant leakage from the refrigerant circuit 20. Specifically, the combustion heater 3 is configured as in each of the embodiments, in order to restrain combustion of the combustible refrigerant leaking from the refrigerant circuit 20 or restrain propagation of flame even upon combustion of the combustible refrigerant. The embodiments will be described hereinafter with reference to FIG. 8 to FIG. 20. An idea from each of the embodiments may alternatively be combined appropriately with an idea from a different one of the embodiments within a range causing no inconsistency.

<Details of Combustion Unit>

Figure 8:
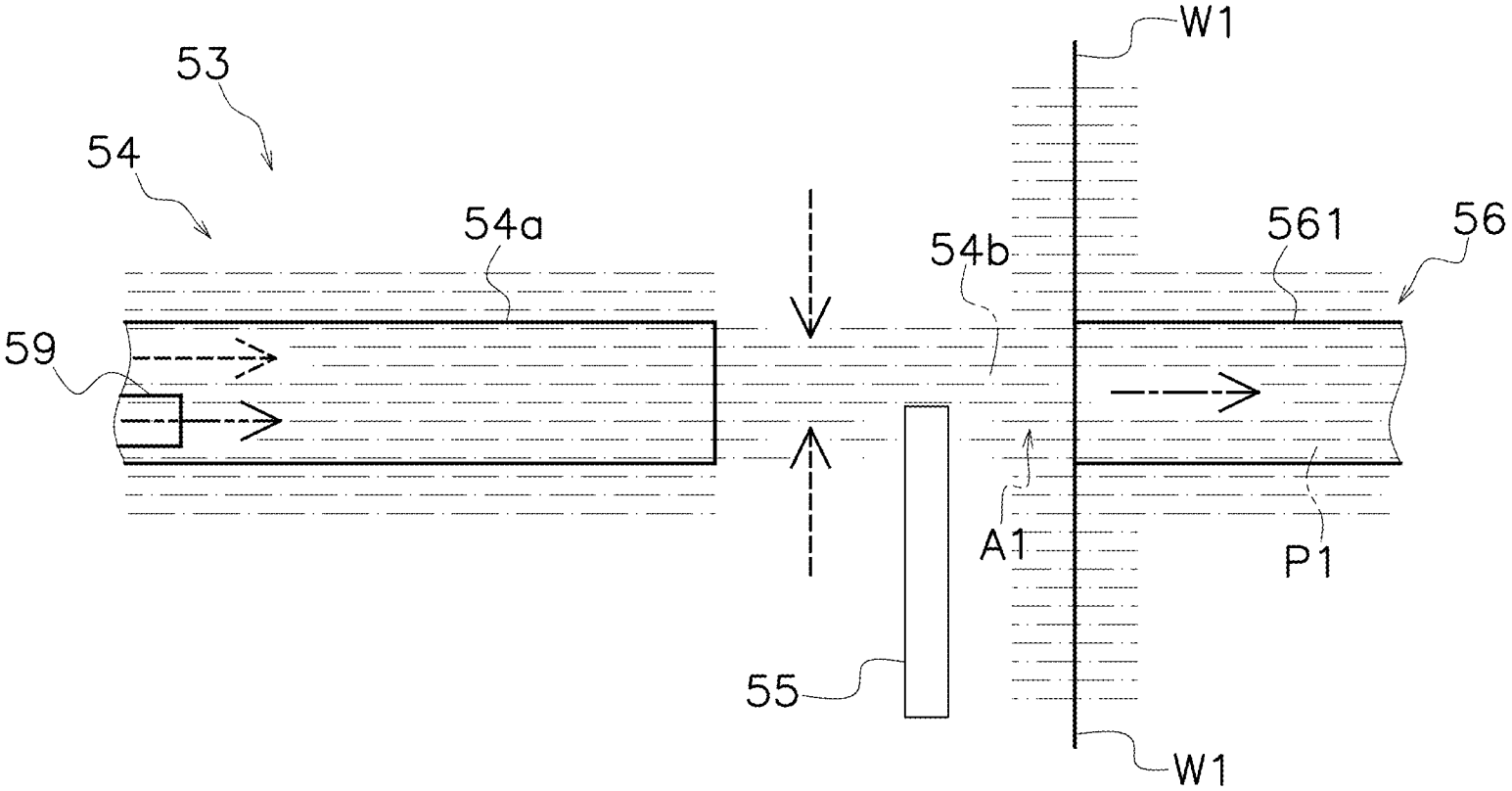
FIG. 8 is an enlarged pattern diagram of a combustion unit and a periphery thereof.

FIG. 8 is an enlarged pattern diagram of the combustion unit 53 and a periphery of the combustion unit 53. The site "a periphery of the combustion unit 53" in this case is any one of a space for generation of flame, a portion in contact with flame, and a portion or a space increased in temperature (to at least 700° C.) to cause ignition of the combustible refrigerant through direct or indirect influence of heat generated at the combustion unit, which are vicinities to the combustion unit 53 in operation. The examples of the site "a periphery of the combustion unit" include the partition wall W1 and at least part of a portion μl (in FIG. 8, FIG. 9, FIG. 13, FIG. 14, and FIG. 16 to FIG. 20) hatched by dashed lines. FIG. 8, FIG. 9, FIG. 13, FIG. 14, and FIG. 16 to FIG. 20 each include a flow of fuel gas indicated by an arrow of a two-dot chain line, a flow of air indicated by an arrow of a broken line, and a flow of combustion gas indicated by an arrow of a dashed line.

The burner unit 54 in the combustion unit 53 includes a burner pipe 54*a*. The burner pipe 54*a* communicates with the air supply pipe 57 and the fuel gas supply pipe 59. The burner pipe 54*a* is supplied with fuel gas from the fuel gas supply pipe 59 (arrows of two-dot chain lines in FIG. 8). The burner pipe 54*a* also receives air to be mixed with fuel gas (arrows of broken lines in FIG. 8).

The burner unit 54 forms a combustion space 54*b*. The combustion space 54*b* allows combustion of mixed gas and generation of flame during operation. The combustion space 54*b* is provided between a downstream end in an air flow direction of the burner pipe 54*a*, and the partition wall W1 and the furnace heat exchanger 56. The combustion space 54*b* is provided with the ignition unit 55. The combustion space 54*b* receives ambient air to be mixed with fuel gas (arrows of broken lines in FIG. 8). The combustion space 54*b* communicates with a heat exchanger pipe 561 of the furnace heat exchanger 56. The heat exchanger pipe 561 (flow path forming member) forms a flow path P1 for combustion gas having passed through the combustion unit 53.

Mixed gas obtained in the burner pipe 54*a* and the combustion space 54*b* is ignited by the ignition unit 55 in the combustion space 54*b*. The combustion space 54*b* accordingly has flame for generation of combustion gas. The combustion gas flows through the heat exchanger pipe 561 (an arrow of a dashed line in FIG. 8) and exchanges heat with air on the blast flow path 30*a*.

The combustion unit 53 may alternatively include a plurality of burner units 54. In such a case, the burner units 54 may be individually provided with different ignition units 55, or may be provided with a common ignition unit 55. Alternatively, a single ignition unit 55 may ignite one of the burner units 54 and the remaining burner units 54 may be ignited by means of flame thus generated. In other words, the plurality of burner units 54 may be ignited by the common ignition unit 55.

During operation, the burner pipe 54*a*, the partition wall W1, and a portion close to an inlet end of the heat exchanger pipe 561 may have surface temperature of 1000° C. or more. A combustible refrigerant may burn when in contact with a portion having temperature of 700° C. or more, flame or combustion gas in the combustion space 54*b*. The idea according to each of the following embodiments is effective as a measure against refrigerant leakage in the combustion heater 3 disposed adjacent to the refrigerant circuit 20.

First Embodiment

Figure 9:
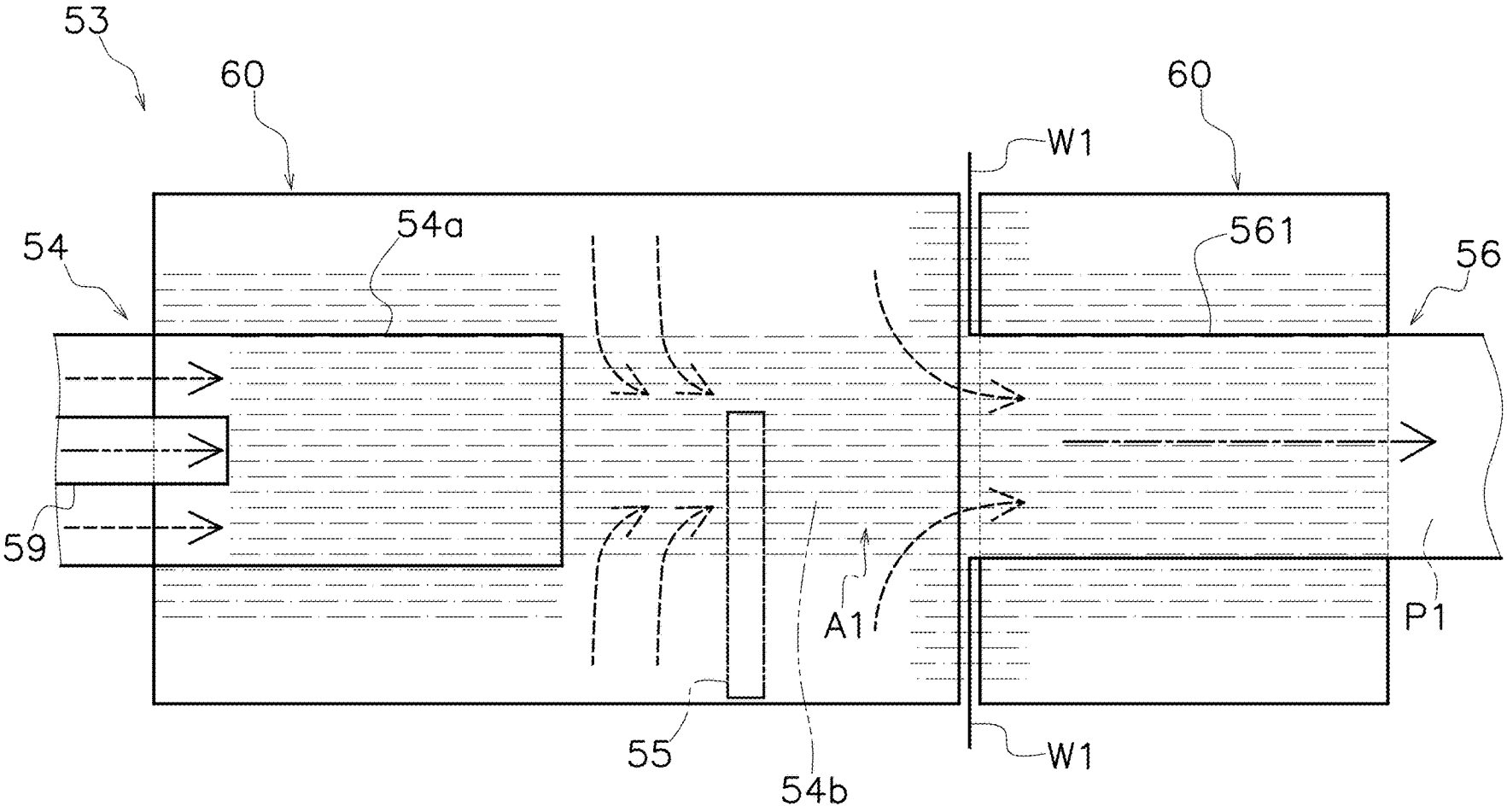
FIG. 9 is a pattern diagram of a combustion unit and a periphery thereof in an exemplary combustion heater according to a first embodiment.

FIG. 9 is a pattern diagram of the combustion unit 53 and the periphery thereof in an exemplary combustion heater 3 according to the first embodiment. The combustion heater 3 according to the first embodiment has a porous body 60 depicted in FIG. 10.

Figure 10:
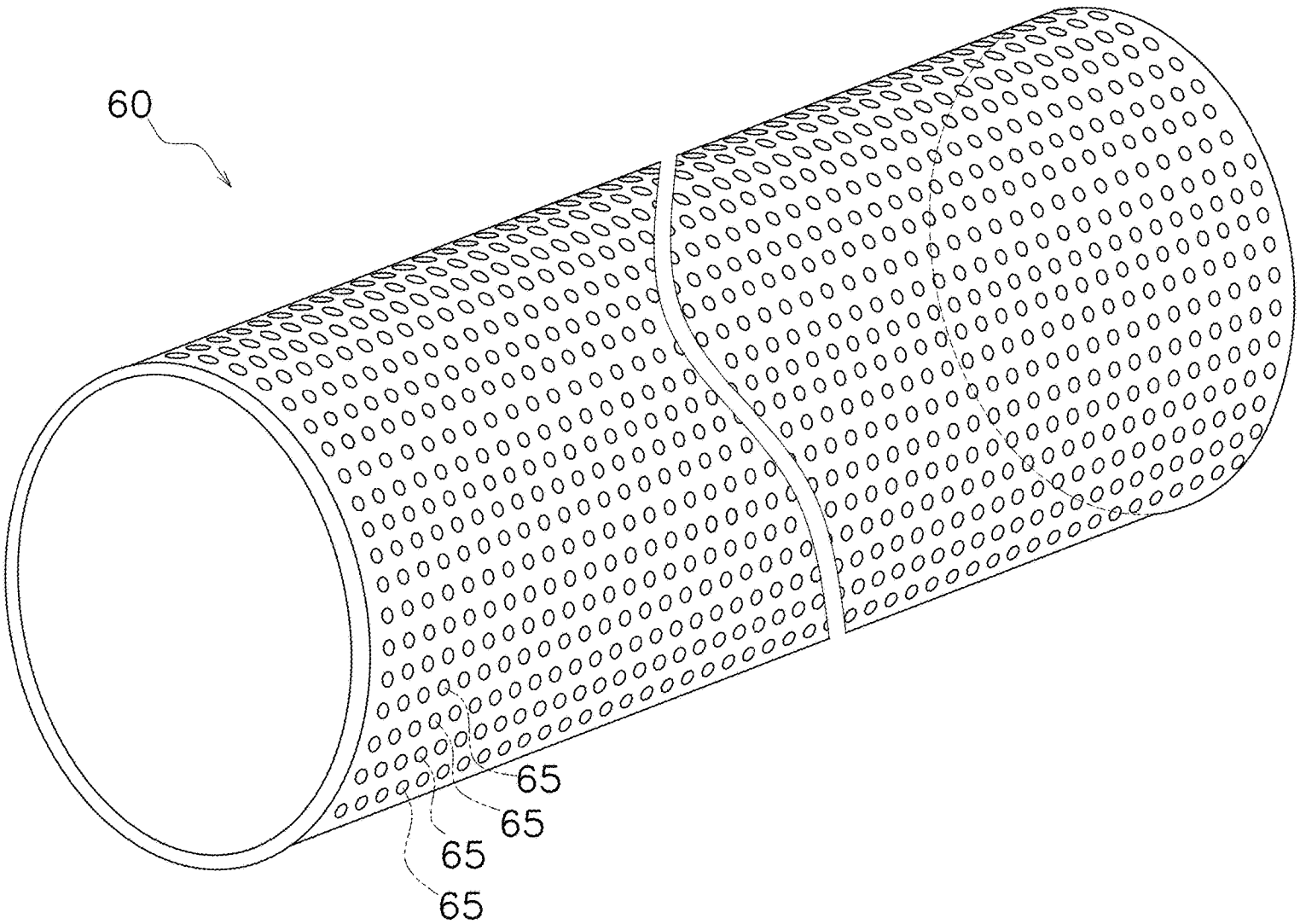
FIG. 10 is a perspective view of an exemplary porous body.

FIG. 10 is a perspective view exemplifying the porous body 60. The porous body 60 is a tubular member. The porous body 60 is made of a material resistant to heat at the combustion unit 53 or around the combustion unit 53. The porous body 60 may be made of a metal, or may alternatively be made of a different material. The porous body 60 depicted in FIG. 10 has a cylindrical shape. The porous body 60 may alternatively have a square tubular shape.

The porous body 60 covers the combustion unit 53 and the periphery of the combustion unit 53 to cause the combustion unit 53 to be positioned in the porous body 60. In other words, the porous body 60 at least partially covers a space receiving any combustible refrigerant leaking from the refrigerant circuit 20, and a member in contact with the combustible refrigerant having leaked. More specifically, the porous body 60 covers a region (a portion hatched by dashed lines or the like in FIG. 9) which can have flame generated in connection with combustion of the combustible refrigerant due to flame, heat, heat radiation, or the like generated in the combustion heater 3 upon refrigerant leakage from the refrigerant circuit 20. For example, the porous body 60 covers the burner pipe 54*a*, the combustion space 54*b*, a portion close to an inlet end of the heat exchanger pipe 561, and the like which constitute the combustion unit 53.

Figure 11:
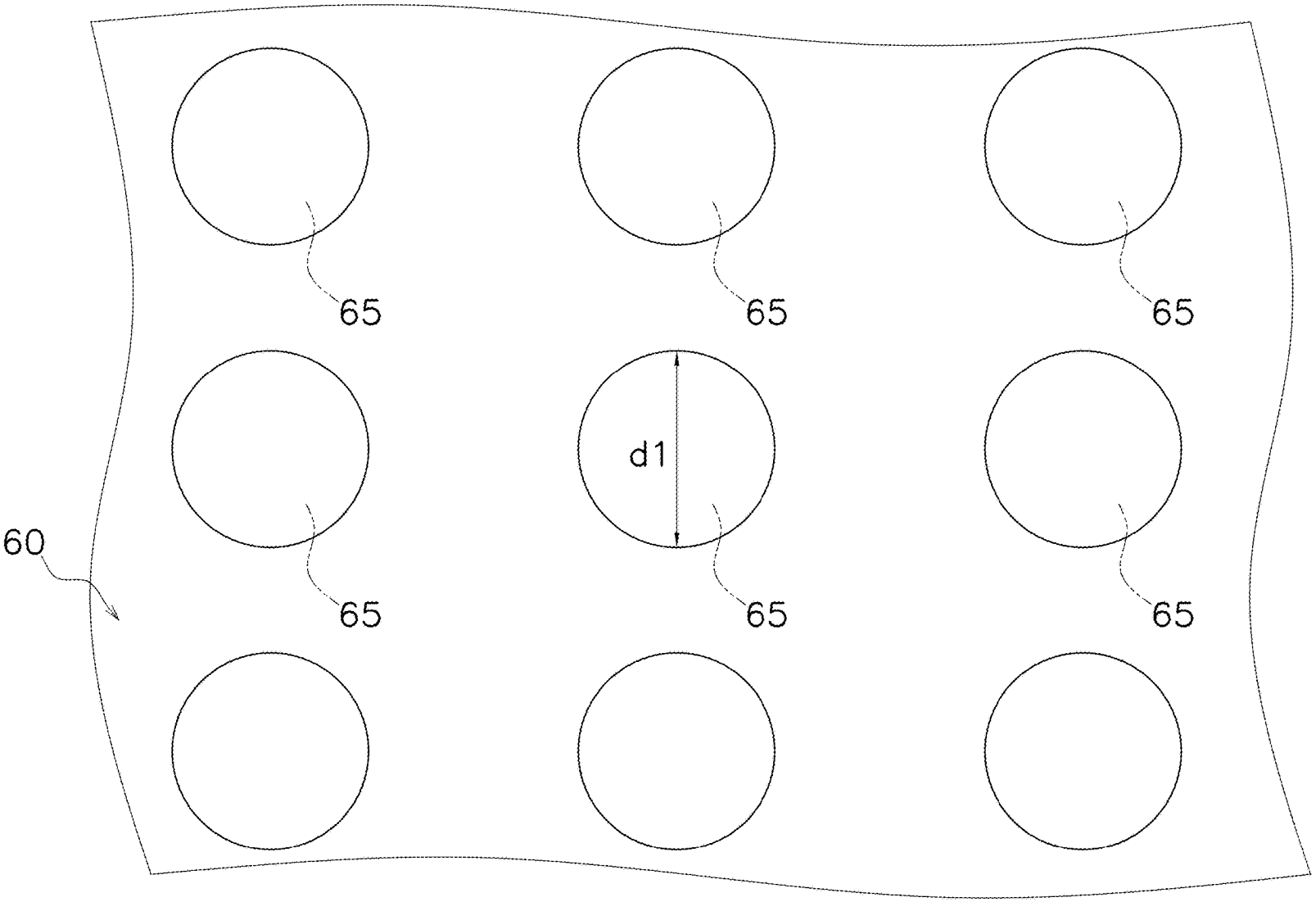
FIG. 11 is an enlarged view of holes provided in the porous body.

The porous body 60 has a plurality of holes 65. More specifically, the porous body 60 has a large number of holes 65 dispersed on its entire circumference. FIG. 11 is an enlarged view of the holes 65. The holes 65 are sized to restrain propagation of flame generated in the combustion space 54*b*. In more detail, the holes 65 are sized to restrain propagation of flame generated by combustion of any leaked combustible refrigerant at the combustion unit 53 or around the combustion unit 53 from around the combustion unit 53 to the outside. Specifically, the holes 65 have a diameter d1 (see FIG. 11) equal to or less than an extinction diameter d of the combustible refrigerant filled in the refrigerant circuit 20. The extinction diameter d is a diameter of a hole that can restrain passage of flame generated by combustion of the combustible refrigerant. Examples of the extinction diameter d include a hole diameter enough to restrain propagation of flame generated upon ignition of the combustible refrigerant due to flame, heat, or the like at the combustion unit 53 or around the combustion unit 53.

Figure 12:
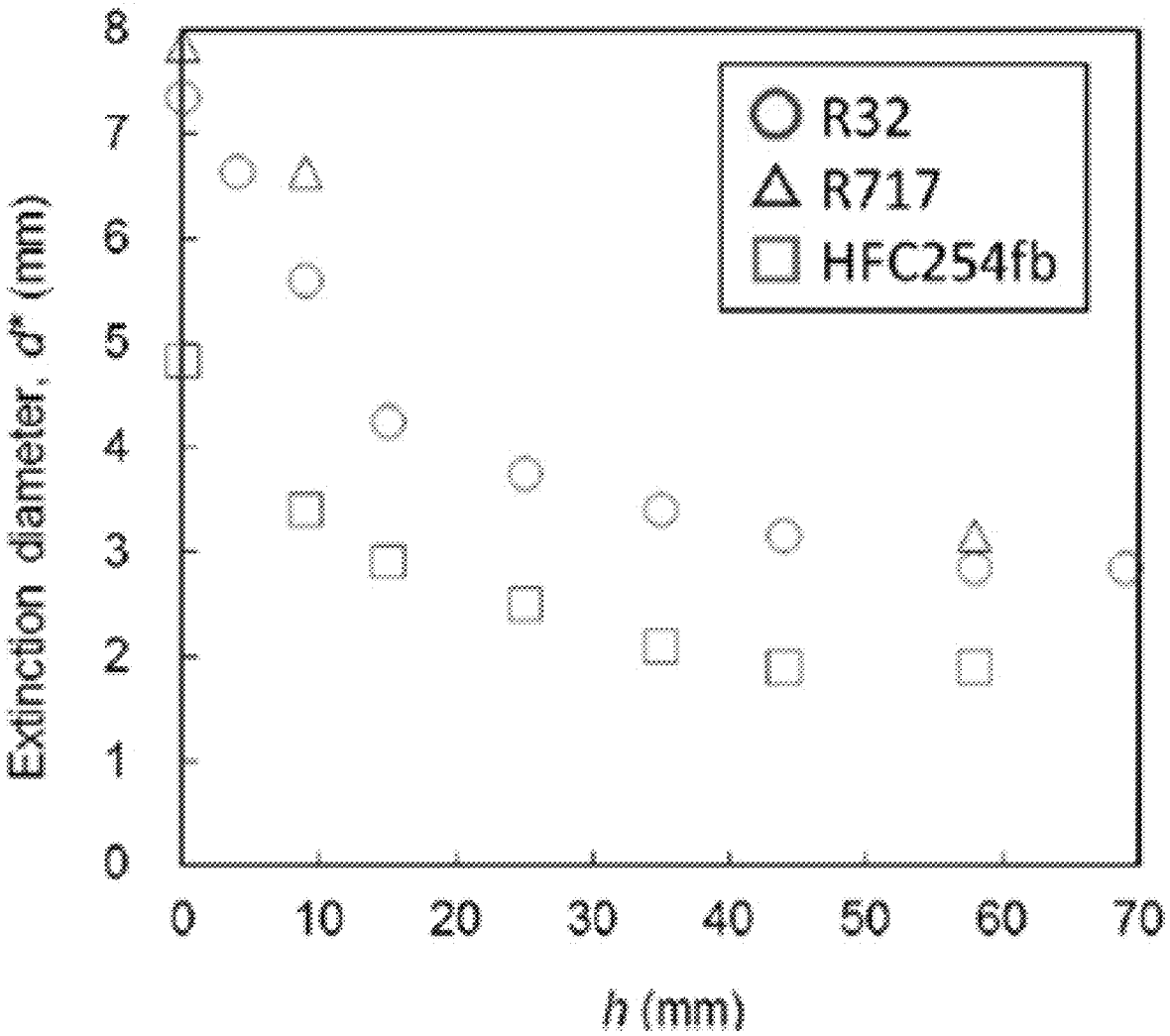
FIG. 12 is a pattern graph exemplifying extinction diameters of combustible refrigerants.

FIG. 12 is a pattern graph exemplifying the extinction diameters d of combustible refrigerants (FIG. 12 is based on page 35 of Final Report, Risk Assessment of Mildly Flammable Refrigerants, Japan Society of Refrigerating and Air Conditioning Engineers). FIG. 12 indicates the extinction diameters d of R32, R717, and HFC254fb as exemplary combustible refrigerants, according to a distance h from flame or an ignition site. FIG. 12 indicates that the extinction diameter d increases as the distance h decreases, whereas the extinction diameter d decreases as the distance h increases. As to R32 in FIG. 12, the extinction diameter with the distance h of 0 mm is 7 mm to 7.5 mm, and the extinction diameter with the distance h of 60 mm is about 3 mm. As to R717 in FIG. 12, the extinction diameter with the distance h of 0 mm is 7.5 mm to 8 mm, and the extinction diameter with the distance h of 60 mm is 3 mm to 3.5 mm. As to HFC254fb in FIG. 12, the extinction diameter with the distance h of 0 mm is 4.5 mm to 5 mm, and the extinction diameter with the distance h of 60 mm is about 2 mm.

In the combustion heater 3 according to the first embodiment, the porous body 60 provided with the plurality of holes 65 covers the space receiving any combustible refrigerant leaking from the refrigerant circuit 20, and the member in contact with any combustible refrigerant leaking from the refrigerant circuit 20, and the diameter d1 of the holes 65 is equal to or less than the extinction diameter d of the combustible refrigerant. In other words, the porous body 60 provided with the large number of holes 65 having the diameter equal to or less then the extinction diameter d of the combustible refrigerant covers the region that can have flame generated in connection with combustion of the combustible refrigerant due to flame, heat, heat radiation, or the like generated in the combustion heater 3 upon refrigerant leakage from the refrigerant circuit 20 adjacent to the porous body 60. Even in a case where any combustible refrigerant leaking from the refrigerant circuit 20 burns at the combustion unit 53 or around the combustion unit 53, generated flame is covered with the porous body 60 and is thus restrained from propagating to a periphery by the holes 65. The combustion heater 3 thus achieves excellent security against refrigerant leakage even when the combustion heater 3 is disposed adjacent to the refrigerant circuit 20 filled with the combustible refrigerant.

The combustion space 54*b* can also receive air via the holes 65 of the porous body 60 during operation. Positioning of the porous body 60 is selected appropriately in terms of security in accordance with design specification and installation environment. The porous body 60 can be appropriately modified in terms of its shape unless functional effect has inconsistency. The diameter d1 of the holes 65 is appropriately set in accordance with the extinction diameter d of the combustible refrigerant filled in the refrigerant circuit 20, the distance h, design specification, installation environment, or the like.

When the combustion unit 53 includes the plurality of burner units 54, the burner units 54 may be individually covered with different porous bodies 60. For example, each of the burner units 54 may be provided with a corresponding one of the porous bodies 60.

Still alternatively, the plurality of burner units 54 to be ignited by the common ignition unit 55 may be covered with a single porous body 60. This configuration can thus restrain increase in the number of the ignition units 55 without inhibiting ignition, at the plurality of burner units 54, of flame generated by ignition of the single ignition unit 55.

Second Embodiment

Figure 13:
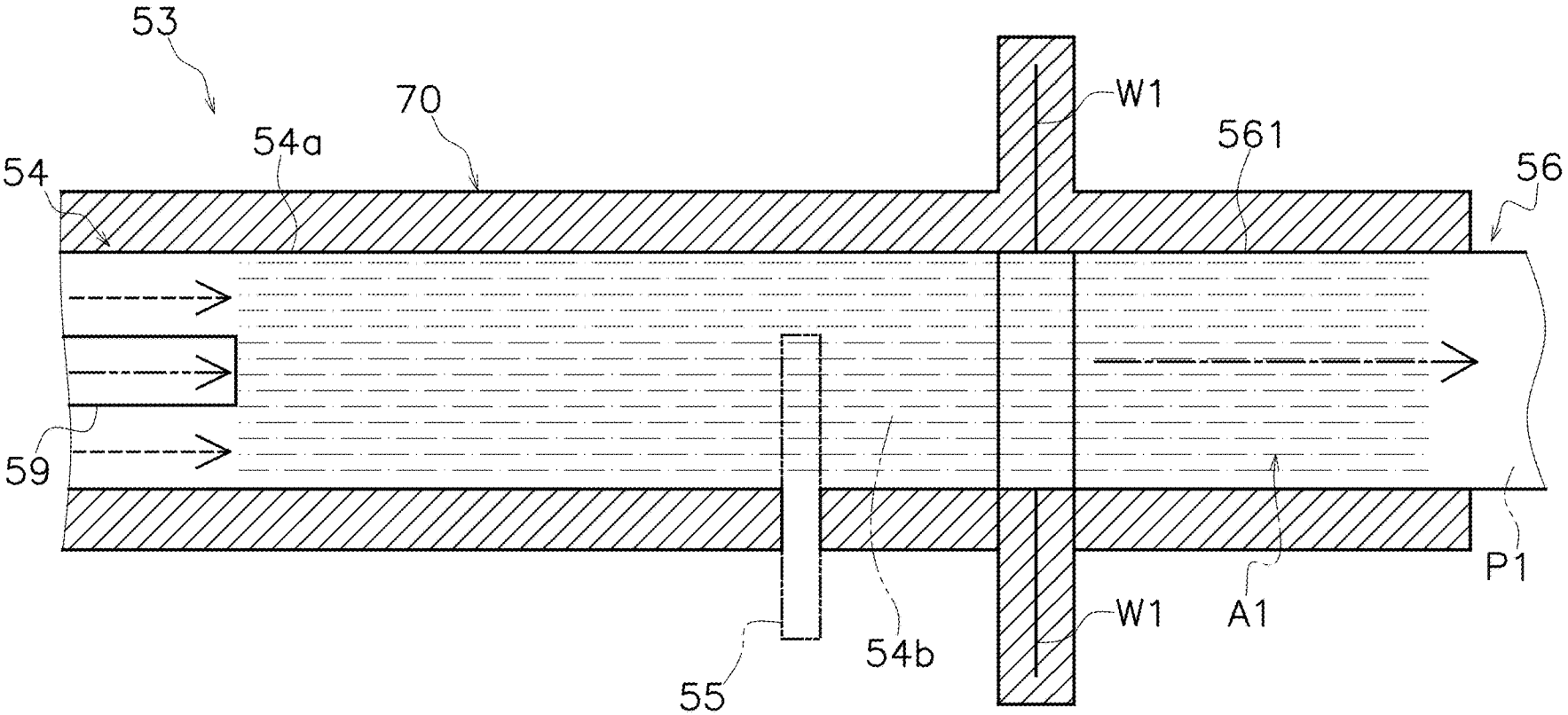
FIG. 13 is a pattern diagram of a combustion unit and a periphery thereof in an exemplary combustion heater according to a second embodiment.

FIG. 13 is a pattern diagram of the combustion unit 53 and the periphery thereof in an exemplary combustion heater 3 according to the second embodiment. In the combustion heater 3 according to the second embodiment, the combustion space 54*b* is provided in the burner pipe 54*a*.

The combustion heater 3 according to the second embodiment includes a heat insulator 70 (portion hatched by solid lines) depicted in FIG. 13. The heat insulator 70 is made of a material resistant to heat at the combustion unit 53 or around the combustion unit 53.

The heat insulator 70 is disposed to cover the combustion unit 53 and a member disposed around the combustion unit 53. In other words, the heat insulator 70 at least partially covers a member disposed at and around the combustion unit 53 and positioned to be in contact with any combustible refrigerant leaking from the refrigerant circuit 20. In particular, the heat insulator 70 covers a portion positioned to be in contact with any refrigerant leaking from the refrigerant circuit 20 and having 700° C. or more during operation. For example, the heat insulator 70 covers the burner pipe 54*a*, the portion close to the inlet end of the heat exchanger pipe 561, the partition wall W1 separating the combustion unit 53 and the furnace heat exchanger 56, and the like.

In the combustion heater 3 according to the second embodiment, the heat insulator 70 at least partially covers the member disposed at and around the combustion unit 53 and positioned to be in contact with any combustible refrigerant leaking from the refrigerant circuit 20. In other words, the heat insulator 70 covers the member disposed around the combustion unit 53 and increased in temperature. Even when any combustible refrigerant leaks from the adjacent refrigerant circuit 20, the leaked combustible refrigerant is thus restrained from burning by coming into contact with the member increased in temperature. The combustion heater 3 thus achieves excellent security against refrigerant leakage even when the combustion heater 3 is disposed adjacent to the refrigerant circuit 20 filled with the combustible refrigerant.

Positioning of the heat insulator 70 is selected appropriately in terms of security in accordance with design specification and installation environment. The heat insulator 70 can be appropriately changed in terms of its shape and material unless functional effect has inconsistency.

Third Embodiment

There may be adopted both the porous body 60 according to the first embodiment and the heat insulator 70 according to the second embodiment. In other words, the combustion heater 3 may alternatively be configured such that the porous body 60 provided with the plurality of holes 65 at least partially covers the space receiving any combustible refrigerant leaking from the refrigerant circuit 20 and the member in contact with any combustible refrigerant leaking from the refrigerant circuit 20, and the heat insulator 70 at least partially covers the member disposed at and around the combustion unit 53 and positioned to be in contact with any combustible refrigerant leaking from the refrigerant circuit 20.

Figure 14:
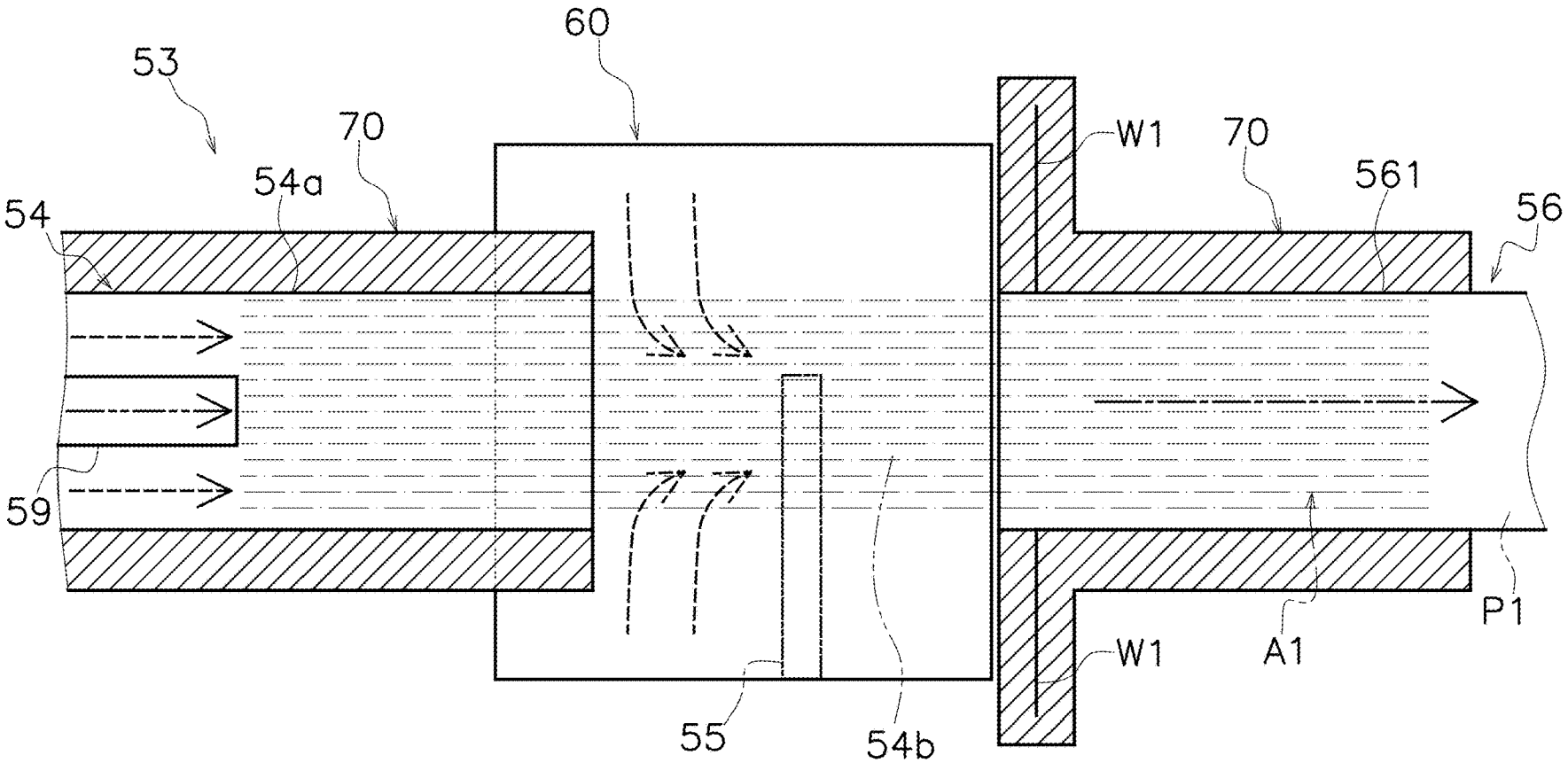
FIG. 14 is a pattern diagram of a combustion unit and a periphery thereof in an exemplary combustion heater according to a third embodiment.

For example, both the porous body 60 and the heat insulator 70 may be adopted in the mode depicted in FIG. 14. FIG. 14 is a pattern diagram of the combustion unit 53 and the periphery thereof in the exemplary combustion heater 3 according to the third embodiment.

The combustion heater 3 according to the third embodiment includes the porous body 60 and the heat insulator 70. In the combustion heater 3 according to the third embodiment, the heat insulator 70 partially covers the portion covered with the porous body 60 in the combustion heater 3 according to the first embodiment. Specifically, in the combustion heater 3 according to the third embodiment, the porous body 60 covers part of the burner pipe 54*a* and the combustion space 54*b*. As in the second embodiment, the heat insulator 70 covers the burner pipe 54*a*, the portion close to the inlet end of the heat exchanger pipe 561, the partition wall W1 separating the combustion unit 53 and the furnace heat exchanger 56, and the like.

In the combustion heater 3 according to the third embodiment, the porous body 60 provided with the plurality of holes 65 covers the space receiving any combustible refrigerant leaking from the refrigerant circuit 20, and the member in contact with any combustible refrigerant leaking from the refrigerant circuit 20, and the diameter d1 of the holes 65 is equal to or less than the extinction diameter d of the combustible refrigerant. Even in a case where any combustible refrigerant leaking from the refrigerant circuit 20 burns at the combustion unit 53 or around the combustion unit 53, generated flame is covered with the porous body 60 and is thus restrained from propagating to a periphery by the holes 65.

Furthermore, the heat insulator 70 at least partially covers a member disposed at and around the combustion unit 53 and positioned to be in contact with any combustible refrigerant leaking from the refrigerant circuit 20. Even when any combustible refrigerant leaks from the adjacent refrigerant circuit 20, the leaked combustible refrigerant is thus restrained from burning by coming into contact with the member increased in temperature.

The combustion heater 3 thus achieves particularly excellent security against refrigerant leakage even when the combustion heater 3 is disposed adjacent to the refrigerant circuit 20 filled with the combustible refrigerant.

The mode of adopting both the porous body 60 and the heat insulator 70 is not necessarily limited to the mode depicted in FIG. 14 but can be modified appropriately. For example, the porous body 60 may cover the portion close to the inlet end of the heat exchanger pipe 561 in FIG. 14. Alternatively, the porous body 60 may cover the burner pipe 54*a* in FIG. 14. Still alternatively, the heat insulator 70 may cover the partition wall W1 in FIG. 9.

Fourth Embodiment

The combustion heater 3 according to the fourth embodiment is configured such that, during operation, gas flow speed in at least one of the combustion unit 53, the periphery of the combustion unit 53, and the inlet of the heat exchanger pipe 561 is at least higher than combustion speed of the combustible refrigerant. The "gas" in this case is at least one of fuel gas, air mixed with fuel gas, mixed gas of fuel gas and air, and combustion gas generated by combustion of the mixed gas. The flow speed of the "gas" corresponds to flow speed of "gas" in a direction opposite by 180 degrees from a propagation direction of flame generated at the combustion unit 53, the periphery of the combustion unit 53, or the inlet of the heat exchanger pipe 561. Even in a case where any combustible refrigerant leaking from the refrigerant circuit 20 burns at the combustion unit 53, flame is thus restrained from propagating to a periphery. The combustion heater 3 thus achieves excellent security against refrigerant leakage even when the combustion heater 3 is disposed adjacent to the refrigerant circuit 20 filled with the combustible refrigerant.

FIG. 15 is a pattern chart indicating combustion speed (cm/sec) of exemplary combustible refrigerants (R32, R1234yf, R452B, R290, and R600a) (FIG. 15 is based on page 14 and the like of Final Report, Risk Assessment of Mildly Flammable Refrigerants, Japan Society of Refrigerating and Air Conditioning Engineers). FIG. 15 indicates that combustion speed of R32 is 6.7 cm/sec, combustion speed of R1234yf is 1.5 cm/sec, combustion speed of R452B is less than 4.0 cm/sec, combustion speed of R290 is 38.7 cm/sec, and combustion speed of R600a is 34.2 cm/sec.

Figure 16:
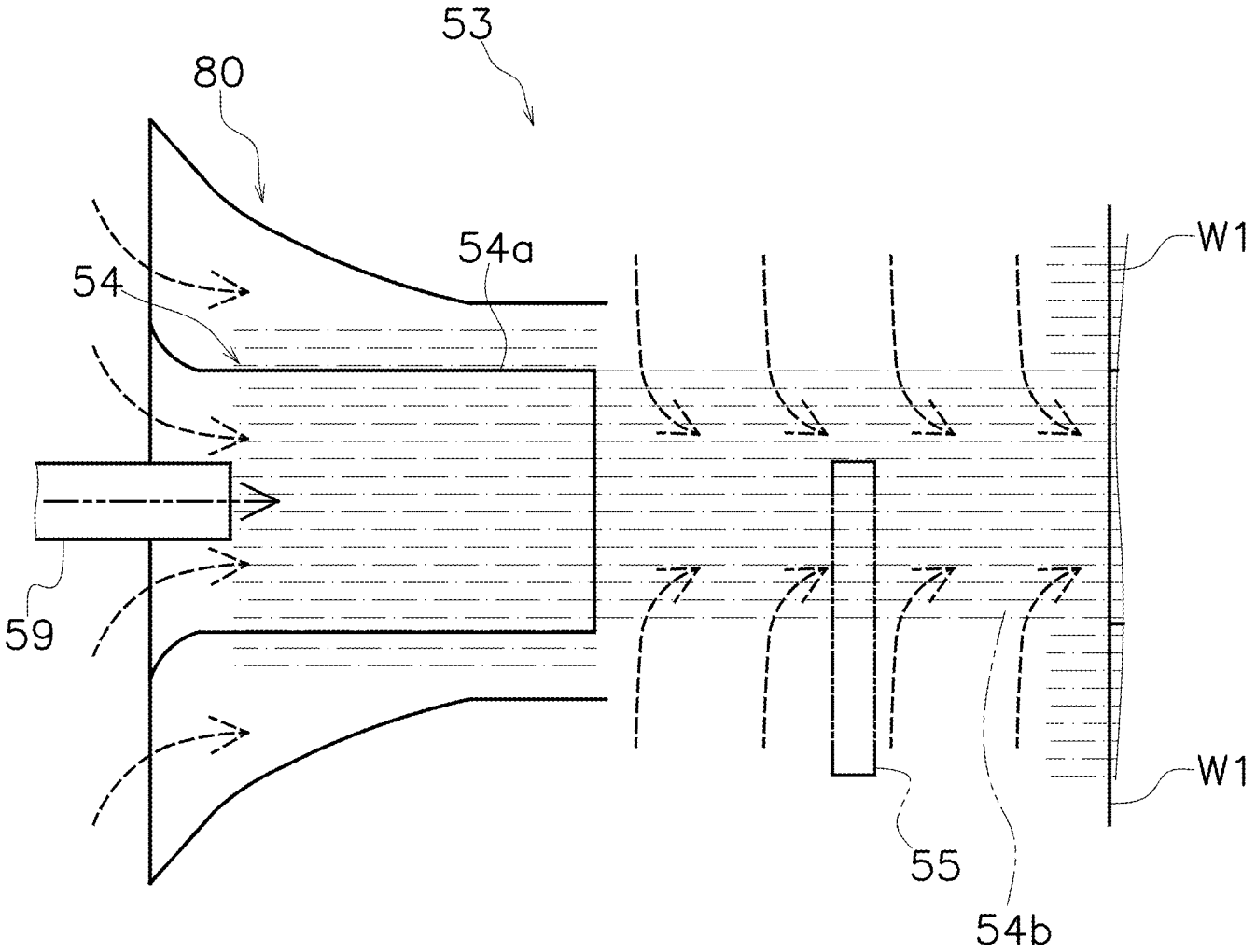
FIG. 16 is a pattern diagram of a combustion unit and a periphery thereof in an exemplary combustion heater according to a fourth embodiment.

There is provided a rectifier member 80 exemplarily depicted in FIG. 16 in order to keep the gas flow speed in at least one of the combustion unit 53, the periphery of the combustion unit 53, and the inlet of the heat exchanger pipe 561 to be higher than the combustion speed of the combustible refrigerant during operation. FIG. 16 is a pattern diagram of the combustion unit 53 and the periphery thereof in the exemplary combustion heater 3 according to the fourth embodiment.

The rectifier member 80 is disposed around the combustion unit 53. The rectifier member 80 is a tubular member. The rectifier member 80 is made of a material resistant to heat at the combustion unit 53 or around the combustion unit 53. The rectifier member 80 may be made of a metal, or may alternatively be made of a different material. The rectifier member 80 may be formed integrally or may include a plurality of separate members assembled together.

The rectifier member 80 has a bell mouth shape widely expanding toward an inlet. The rectifier member 80 is disposed around the combustion unit 53. The rectifier member 80 covers the burner pipe 54*a*. The rectifier member 80 receives, via the inlet, air to be mixed with fuel gas. The rectifier member 80 having the bell mouth shape is disposed in this mode to achieve increase in flow speed of air introduced into the combustion unit 53. The gas flow speed of the combustion unit 53, the periphery of the combustion unit 53, and the inlet of the heat exchanger pipe 561 can thus be made higher than the combustion speed of the combustible refrigerant during operation.

Alternatively, the gas flow speed in at least one of the combustion unit 53, the periphery of the combustion unit 53, and the inlet of the heat exchanger pipe 561 during operation may be made higher than flame propagation speed of the combustible refrigerant. Even in a case where any combustible refrigerant leaking from the refrigerant circuit 20 burns at the combustion unit 53, flame is thus particularly restrained from propagating to a periphery. The combustion heater 3 thus achieves particularly excellent security against refrigerant leakage even when the combustion heater 3 is disposed adjacent to the refrigerant circuit 20 filled with the combustible refrigerant.

The rectifier member 80 can be appropriately modified in terms of the shape, the configuration mode, or the disposition mode as long as the gas flow speed in at least one of the combustion unit 53, the periphery of the combustion unit 53, and the inlet of the heat exchanger pipe 561 can be made higher than the combustion speed of the combustible refrigerant during operation.

Figure 17:
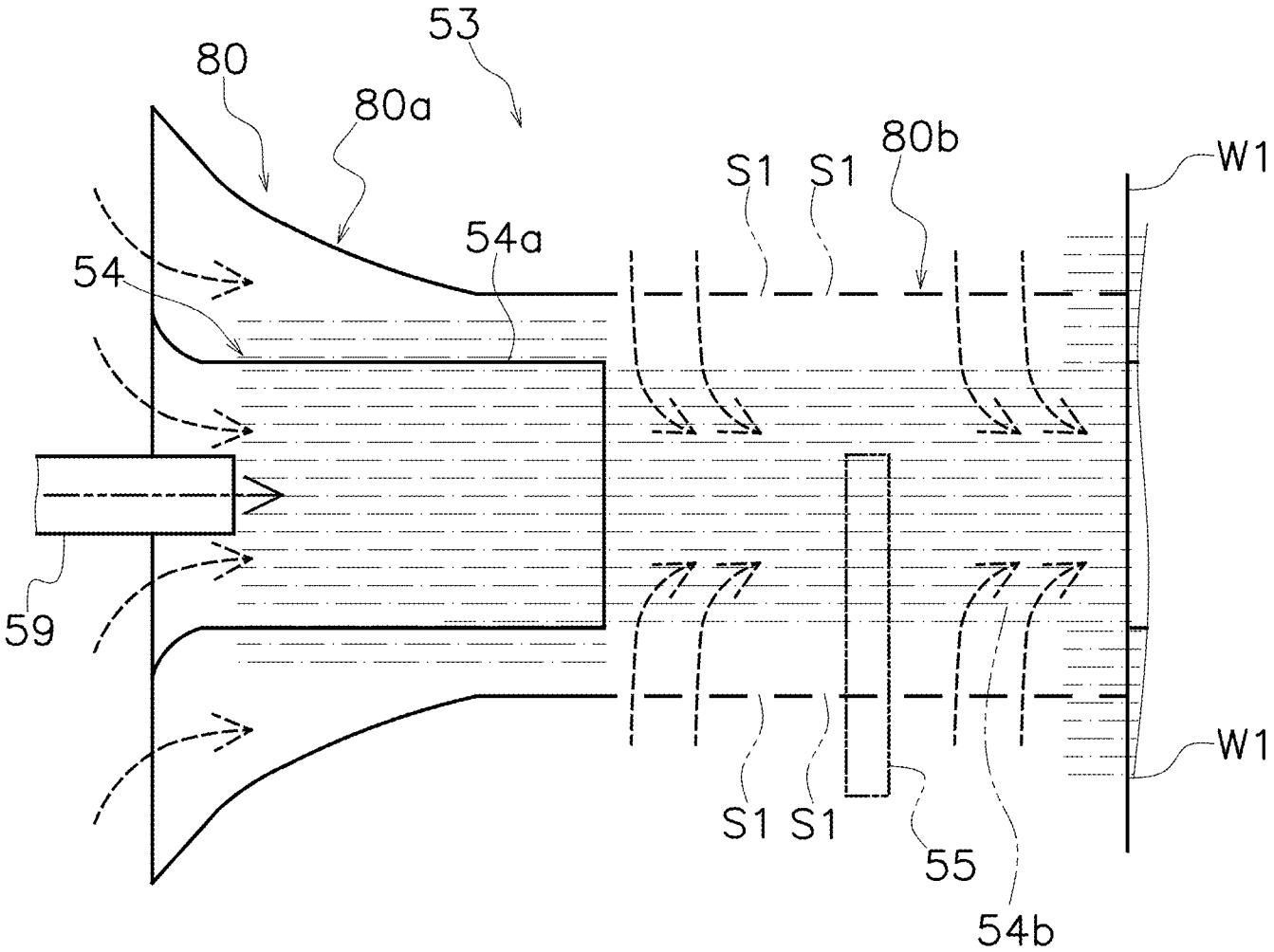
FIG. 17 is a pattern diagram of a combustion unit and a periphery thereof in another exemplary combustion heater according to the fourth embodiment.

The rectifier member 80 may alternatively be configured and disposed in the mode exemplarily depicted in FIG. 17. FIG. 17 is a pattern diagram of the combustion unit 53 and the periphery thereof in another exemplary combustion heater 3 according to the fourth embodiment.

The rectifier member 80 depicted in FIG. 17 includes a first rectifier 80*a* and a second rectifier 80*b*. The first rectifier 80*a* and the second rectifier 80*b* may be formed integrally or may be formed separately from each other.

The first rectifier 80*a* has a bell mouth shape widely expanding toward an inlet. The first rectifier 80*a* is disposed around the combustion unit 53. The first rectifier 80*a* covers the burner pipe 54*a*. The first rectifier 80*a* receives, via the inlet, air to be mixed with fuel gas. The first rectifier 80*a* having the bell mouth shape is disposed in this mode to achieve increase in flow speed of air introduced into the combustion unit 53. The gas flow speed of the combustion unit 53, the periphery of the combustion unit 53, and the inlet of the heat exchanger pipe 561 can thus be made higher than the combustion speed of the combustible refrigerant during operation.

The second rectifier 80*b* is positioned closer to the heat exchanger pipe 561 in comparison to the first rectifier 80*a*. The second rectifier 80*b* is disposed around the combustion space 54*b* and covers the combustion space 54*b*. The second rectifier 80*b* is provided with a slit S1 for introduction of air. The combustion space 54*b* receives, via the slit S1, air to be mixed with fuel gas. The second rectifier 80*b* is disposed in this mode and receives air via the slit S1 to achieve increase in flow speed of air introduced into the combustion unit 53. The gas flow speed of the combustion unit 53, the periphery of the combustion unit 53, and the inlet of the heat exchanger pipe 561 can thus be made higher than the combustion speed of the combustible refrigerant during operation.

The first rectifier 80*a* or the second rectifier 80*b* may be appropriately omitted as long as the gas flow speed in at least one of the combustion unit 53, the periphery of the combustion unit 53, and the inlet of the heat exchanger pipe 561 can be made higher than the combustion speed of the combustible refrigerant during operation.

There is not necessarily limited to the rectifier member 80 as the measure to enable the gas flow speed in at least one of the combustion unit 53, the periphery of the combustion unit 53, and the inlet of the heat exchanger pipe 561 to be higher than the combustion speed of the combustible refrigerant during operation, and the rectifier member 80 can be changed appropriately. For example, the following idea may be adopted along with or in place of the rectifier member 80 to cause the gas flow speed in at least one of the combustion unit 53, the periphery of the combustion unit 53, and the inlet of the heat exchanger pipe 561 to be higher than the combustion speed of the combustible refrigerant during operation.

For example, the burner pipe 54*a* itself may have a bell mouth shape to increase flow speed of air introduced into the combustion unit 53. The burner pipe 54*a* depicted in FIG. 16 has the bell mouth shape expanding toward an inlet.

Alternatively, the burner pipe 54*a* depicted in FIG. 13 may be disposed and be provided with a slit near to the combustion space 54*b* to increase flow speed of air introduced into the combustion unit 53.

Still alternatively, the furnace fan 52 may be modified in terms of specification or be increased in the number of rotations to increase flow speed of air introduced into the combustion unit 53.

Fifth Embodiment

There may be adopted both the idea according to the fourth embodiment and the porous body 60 according to the first embodiment. In other words, the combustion heater 3 may be configured such that the gas flow speed in at least one of the combustion unit 53, the periphery of the combustion unit 53, and the inlet of the heat exchanger pipe 561 is higher than the combustion speed of the combustible refrigerant during operation, and the porous body 60 provided with the plurality of holes 65 at least partially covers the space receiving any combustible refrigerant leaking from the refrigerant circuit 20 and the member in contact with any combustible refrigerant leaking from the refrigerant circuit 20.

Figure 18:
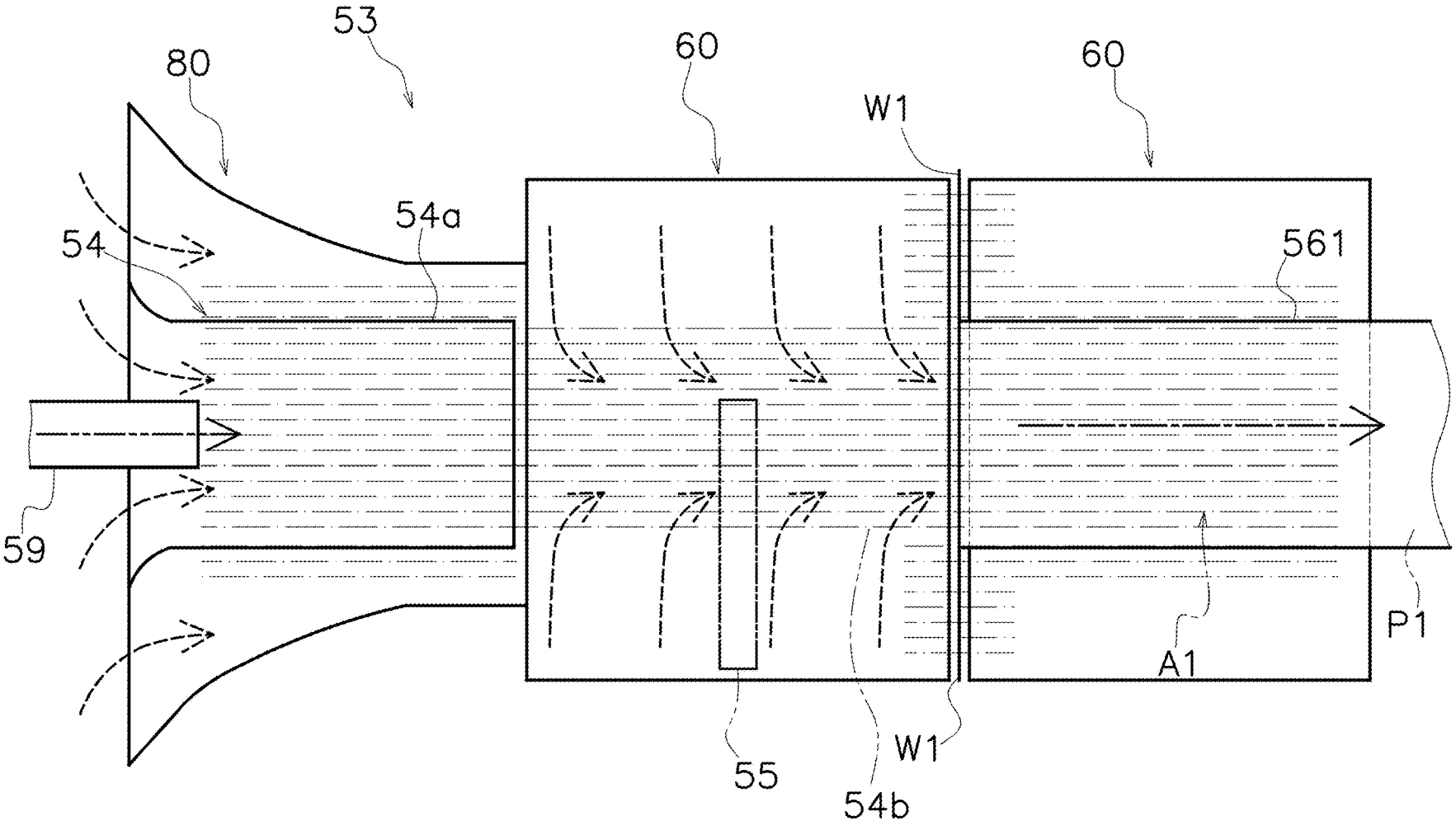
FIG. 18 is a pattern diagram of a combustion unit and a periphery thereof in an exemplary combustion heater according to a fifth embodiment.

In the mode depicted in FIG. 18 or the like, there may be provided both the rectifier member 80 and the porous body 60. FIG. 18 is a pattern diagram of the combustion unit 53 and the periphery thereof in the exemplary combustion heater 3 according to the fifth embodiment.

The combustion heater 3 according to the fifth embodiment includes the rectifier member 80 and the porous body 60. The combustion heater 3 according to the fifth embodiment includes the rectifier member 80 disposed in the mode similar to that depicted in FIG. 16. Furthermore, the combustion space 54*b* is covered with the porous body 60.

The combustion heater 3 according to the fifth embodiment includes the rectifier member 80 disposed to cause the gas flow speed of the combustion unit 53, the periphery of the combustion unit 53, or the inlet of the heat exchanger pipe 561 to be higher than the combustion speed of the combustible refrigerant. Even in a case where any combustible refrigerant leaking from the refrigerant circuit 20 burns at the combustion unit 53, flame is thus restrained from propagating to a periphery.

The porous body 60 provided with the plurality of holes 65 also serves as a member enabling introduction of air. The combustion space 54*b* receives, via the holes 65, air to be mixed with fuel gas. The porous body 60 is disposed in this mode and receives air via the holes 65 to achieve increase in flow speed of air introduced into the combustion unit 53. The gas flow speed of the combustion unit 53, the periphery of the combustion unit 53, and the inlet of the heat exchanger pipe 561 can thus be made higher than the combustion speed of the combustible refrigerant during operation. In other words, the porous body 60 serves as a second rectifier member configured to increase the gas flow speed of the combustion unit 53, the periphery of the combustion unit 53, and the inlet of the heat exchanger pipe 561.

Furthermore, the porous body 60 provided with the plurality of holes 65 is disposed to cover generated flame and restrain propagation of the flame to a periphery by means of the holes 65 even when any combustible refrigerant leaking from the refrigerant circuit 20 burns at the combustion unit 53 or in the periphery of the combustion unit 53.

The combustion heater 3 thus achieves particularly excellent security against refrigerant leakage even when the combustion heater 3 is disposed adjacent to the refrigerant circuit 20 filled with the combustible refrigerant.

The mode of adopting both the idea according to the fourth embodiment and the porous body 60 is not necessarily limited to the mode depicted in FIG. 18 but can be modified appropriately. For example, the burner pipe 54*a* may be covered with the porous body 60. Alternatively, any measure other than the rectifier member 80 may be adopted to cause the gas flow speed in at least one of the combustion unit 53, the periphery of the combustion unit 53, and the inlet of the heat exchanger pipe 561 to be higher than the combustion speed of the combustible refrigerant, and the porous body 60 may be disposed appropriately to improve security.

Sixth Embodiment

There may be adopted both the idea according to the fourth embodiment and the heat insulator 70 according to the second embodiment. In other words, the combustion heater 3 may be configured such that the gas flow speed in at least one of the combustion unit 53, the periphery of the combustion unit 53, and the inlet of the heat exchanger pipe 561 is higher than the combustion speed of the combustible refrigerant during operation, and the heat insulator 70 at least partially covers the member disposed at and around the combustion unit 53 and positioned to be in contact with any combustible refrigerant leaking from the refrigerant circuit 20.

Figure 19:
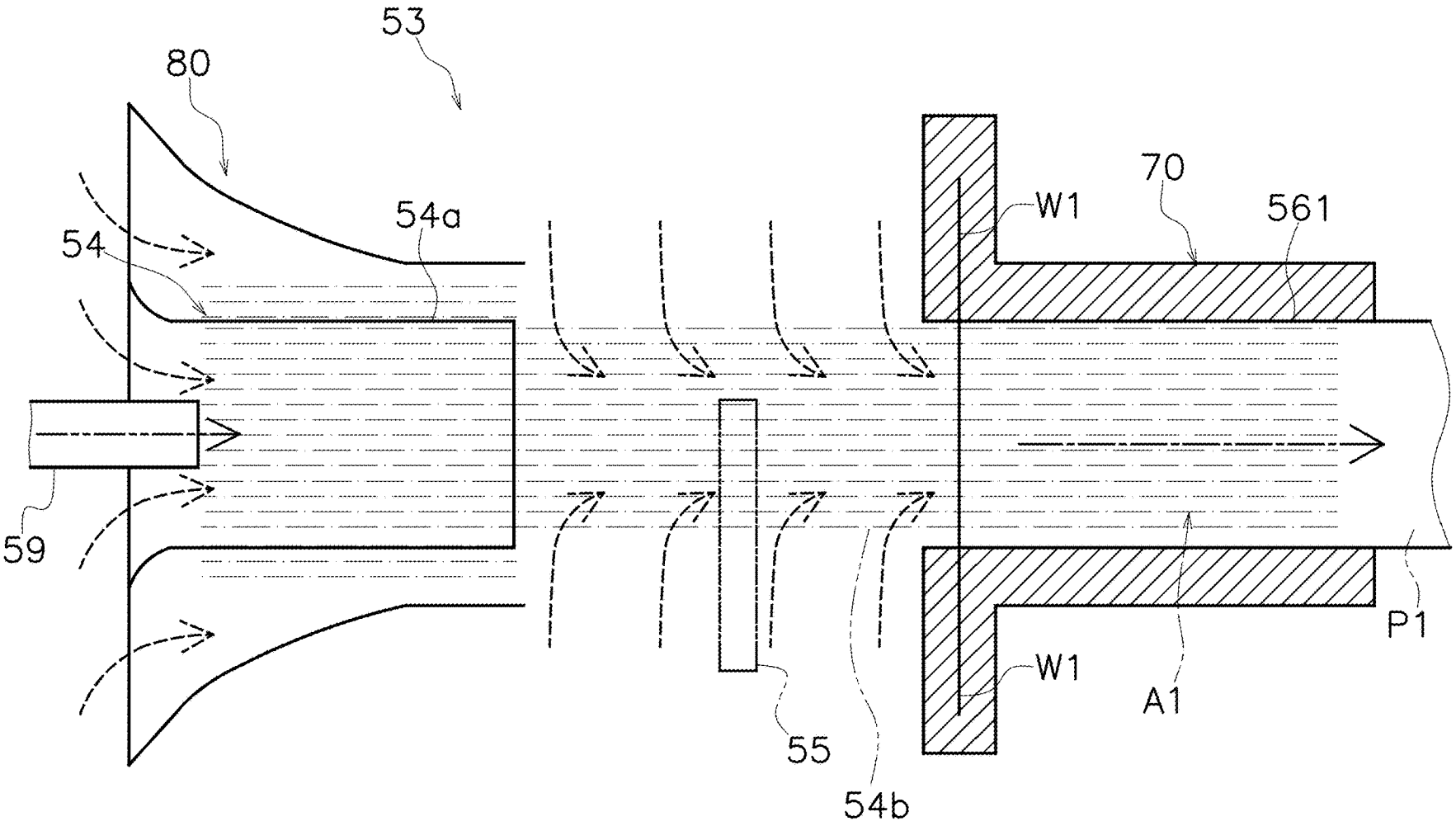
FIG. 19 is a pattern diagram of a combustion unit and a periphery thereof in an exemplary combustion heater according to a sixth embodiment.

In the mode depicted in FIG. 19 or the like, there may be provided both the rectifier member 80 and the heat insulator 70. FIG. 19 is a pattern diagram of the combustion unit 53 and the periphery thereof in the exemplary combustion heater 3 according to the sixth embodiment.

The combustion heater 3 according to the sixth embodiment includes the rectifier member 80 and the heat insulator 70. The combustion heater 3 according to the sixth embodiment includes the rectifier member 80 disposed in the mode similar to that depicted in FIG. 16. Furthermore, the heat insulator 70 covers the partition wall W1 and the portion close to the inlet end of the heat exchanger pipe 561.

The combustion heater 3 according to the sixth embodiment includes the rectifier member 80 disposed to cause the gas flow speed of the combustion unit 53, the periphery of the combustion unit 53, or the inlet of the heat exchanger pipe 561 to be higher than the combustion speed of the combustible refrigerant. Even in a case where any combustible refrigerant leaking from the refrigerant circuit 20 burns at the combustion unit 53, flame is restrained from propagating to a periphery.

Furthermore, the heat insulator 70 at least partially covers the member disposed around the combustion unit 53 and positioned to be in contact with any combustible refrigerant leaking from the refrigerant circuit 20. Even when any combustible refrigerant leaks from the adjacent refrigerant circuit 20, the leaked combustible refrigerant is thus restrained from burning by coming into contact with the member increased in temperature.

The combustion heater 3 thus achieves particularly excellent security against refrigerant leakage even when the combustion heater 3 is disposed adjacent to the refrigerant circuit 20 filled with the combustible refrigerant.

The mode of adopting both the idea according to the fourth embodiment and the heat insulator 70 is not necessarily limited to the mode depicted in FIG. 19 but can be modified appropriately. For example, the burner pipe 54*a* may be covered with the heat insulator 70. Alternatively, any measure other than the rectifier member 80 may be adopted to cause the gas flow speed in at least one of the combustion unit 53, the periphery of the combustion unit 53, and the inlet of the heat exchanger pipe 561 to be higher than the combustion speed of the combustible refrigerant, and the heat insulator 70 may be disposed appropriately to improve security.

Seventh Embodiment

There may be adopted all of the idea according to the fourth embodiment, the porous body 60 according to the first embodiment, and the heat insulator 70 according to the second embodiment. In other words, the gas flow speed in at least one of the combustion unit 53, the periphery of the combustion unit 53, and the inlet of the heat exchanger pipe 561 may be made higher than the combustion speed of the combustible refrigerant during operation, and the porous body 60 according to the first embodiment and the heat insulator 70 according to the second embodiment may further be disposed appropriately.

Figure 20:
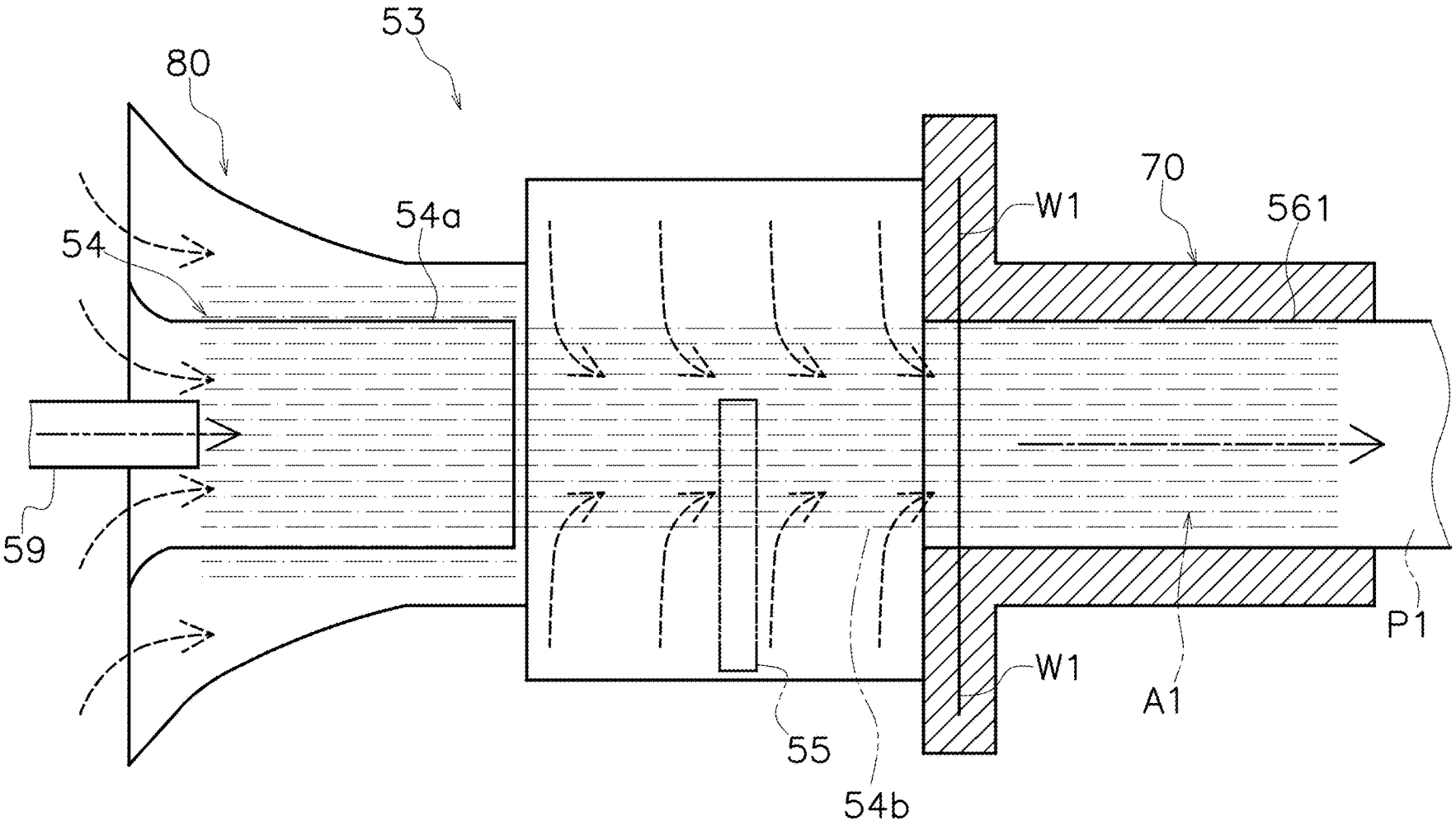
FIG. 20 is a pattern diagram of a combustion unit and a periphery thereof in an exemplary combustion heater according to a seventh embodiment.

In the mode depicted in FIG. 20 or the like, there may be provided all of the rectifier member 80, the porous body 60, and the heat insulator 70. FIG. 20 is a pattern diagram of the combustion unit 53 and the periphery thereof in an exemplary combustion heater 3 according to the seventh embodiment.

The combustion heater 3 according to the seventh embodiment includes the rectifier member 80, the porous body 60, and the heat insulator 70. The combustion heater 3 according to the seventh embodiment includes the rectifier member 80 disposed in the mode similar to that depicted in FIG. 16. Furthermore, the combustion space 54*b* is covered with the porous body 60. Moreover, the heat insulator 70 covers the partition wall W1 and the portion close to the inlet end of the heat exchanger pipe 561.

The combustion heater 3 according to the seventh embodiment includes the rectifier member 80 disposed to cause the gas flow speed of the combustion unit 53, the periphery of the combustion unit 53, or the inlet of the heat exchanger pipe 561 to be higher than the combustion speed of the combustible refrigerant. Even in a case where any combustible refrigerant leaking from the refrigerant circuit 20 burns at the combustion unit 53, flame is restrained from propagating to a periphery.

Furthermore, the porous body 60 provided with the plurality of holes 65 is disposed to cover generated flame and restrain propagation of the flame to a periphery by means of the holes 65 even when any combustible refrigerant leaking from the refrigerant circuit 20 burns at the combustion unit 53 or in the periphery of the combustion unit 53.

Moreover, the heat insulator 70 at least partially covers the member disposed around the combustion unit 53 and positioned to be in contact with any combustible refrigerant leaking from the refrigerant circuit 20. Even when any combustible refrigerant leaks from the adjacent refrigerant circuit 20, the heat insulator 70 covers the member positioned to be in contact with the combustible refrigerant having leaked and increased in temperature to restrain combustion of the leaked refrigerant.

The combustion heater 3 thus achieves particularly excellent security against refrigerant leakage even when the combustion heater 3 is disposed adjacent to the refrigerant circuit 20 filled with the combustible refrigerant.

The mode of adopting all of the idea according to the fourth embodiment, the porous body 60 according to the first embodiment, and the heat insulator 70 according to the second embodiment is not necessarily limited to the mode depicted in FIG. 20 but can be modified appropriately. For example, the heat insulator 70 may cover the burner pipe 54*a* and the porous body 60 may cover the portion close to the inlet end of the heat exchanger pipe 561 in FIG. 20. Alternatively, the rectifier member 80 may cover the burner pipe 54*a* and the porous body 60 may cover the combustion space 54*b* and the portion close to the inlet end of the heat exchanger pipe 561.

Still alternatively, any measure other than the rectifier member 80 may be adopted to cause the gas flow speed in at least one of the combustion unit 53, the periphery of the combustion unit 53, and the inlet of the heat exchanger pipe 561 to be higher than the combustion speed of the combustible refrigerant, and the porous body 60 and the heat insulator 70 may be disposed appropriately to improve security.

Ideas of the Present Disclosure

The present disclosure includes the following ideas.

<1>

A combustion heater (3) disposed adjacent to a refrigerant circuit (20) filled with a combustible refrigerant and configured to generate heat by means of flame, the combustion heater comprising:

a combustion unit (53) causing generation of the flame; and a porous body (60) provided with a plurality of holes (65) and covering the combustion unit or a periphery of the combustion unit, wherein the porous body at least partially covers both or one of a space (54*b*) receiving the combustible refrigerant leaking from the refrigerant circuit and a member (54*a*, 561, 55, W1) in contact with the combustible refrigerant leaking from the refrigerant circuit, and the holes have a diameter (d1) equal to or less than an extinction diameter of the combustible refrigerant.

<2>

A combustion heater (3) disposed adjacent to a refrigerant circuit (20) filled with a combustible refrigerant and configured to generate heat by means of flame, the combustion heater comprising:

a combustion unit (53) causing generation of the flame; and a flow path forming member (561) forming a flow path (P1) for gas having passed through the combustion unit, wherein gas flow speed in at least one of the combustion unit, a periphery of the combustion unit, and an inlet of the flow path forming member is higher than combustion speed of the combustible refrigerant.

<3>

A combustion heater (3) disposed adjacent to a refrigerant circuit (20) filled with a combustible refrigerant and configured to generate heat by means of flame, the combustion heater comprising:

a combustion unit (53) causing generation of the flame; and a heat insulator (70) at least partially covering a member (54*a*, 561, W1) disposed in a periphery of the combustion unit and disposed at a position in contact with the combustible refrigerant leaking from the refrigerant circuit.

<4>

The combustion heater (3) according to <3>, wherein the heat insulator covers a portion of the member, the portion having at least 700 degrees Celsius during operation.

<5>

The combustion heater according to <3> or <4>, further comprising a porous body (60) provided with a plurality of holes (65) and covering the combustion unit or the periphery of the combustion unit, wherein the porous body at least partially covers both or one of a space (54*b*) receiving the combustible refrigerant leaking from the refrigerant circuit and a member (54*a*, 561, 55, W1) in contact with the combustible refrigerant leaking from the refrigerant circuit, and the holes have a diameter (d1) equal to or less than an extinction diameter of the combustible refrigerant.

<6>

The combustion heater according to any one of <1>, and <3> to <5>, further comprising a flow path forming member forming a flow path for gas having passed through the combustion unit, wherein gas flow speed in at least one of the combustion unit, the periphery of the combustion unit, and an inlet of the flow path forming member is higher than combustion speed of the combustible refrigerant.

<7>

An air conditioning system (1) comprising:

a refrigeration apparatus (2) including a refrigerant circuit (20) filled with a combustible refrigerant; and the combustion heater (3) according to any one of <1> to <6>, the combustion heater being disposed adjacent to the refrigeration apparatus.

Supplementary Note

The embodiments have been described above. Various modifications to modes and details will be available without departing from the object and the scope of the claims.

INDUSTRIAL APPLICABILITY

The present disclosure is applicable to a combustion heater or an air conditioning system.

REFERENCE SIGNS LIST

1: air conditioning system
1A: first unit
1B: second unit
2: refrigeration apparatus
3: combustion heater
4: supplier fan
6: liquid-refrigerant connection pipe
7: gas-refrigerant connection pipe
20: refrigerant circuit
21: compressor
23: heat source heat exchanger
24: heat source expansion valve
25: heat source fan
30: case
30*a*: blast flow path
41: utilization expansion valve
42: utilization heat exchanger
43: fan
51: fuel gas valve
52: furnace fan
53: combustion unit
54: burner unit
54*a*: burner pipe
54*b*: combustion space
55: ignition unit
56: furnace heat exchanger
57: air supply pipe
58: air exhaust pipe
59: fuel gas supply pipe
60: porous body
65: hole
70: heat insulator
80: rectifier member
80*a*: first rectifier
80*b*: second rectifier
100: house
561: heat exchanger pipe
B1: basement
D1: duct
H1: air outlet
H2: air inlet
P1: flow path
R1: room
RF1: roof
S1: slit
W1: partition wall
d1: diameter

The invention claimed is:

1. A combustion heater disposed adjacent to a refrigerant circuit filled with a combustible refrigerant and configured to generate heat by means of flame, the combustion heater comprising:

a combustion unit comprising a burner for causing generation of flame; and a porous body separate from the combustion unit which covers the combustion unit or a periphery of the combustion unit, wherein the porous body at least partially covers both or one of a space receiving the combustible refrigerant leaking from the refrigerant circuit and a member in contact with the combustible refrigerant leaking from the refrigerant circuit, and is provided with a plurality of holes, and the holes have a diameter equal to or less than an extinction diameter of the combustible refrigerant, to restrain propagation of flame generated by combustion of any leak of the combustible refrigerant, at the combustion unit or around the combustion unit, from passing through the porous body to an outside of the porous body.

2. The combustion heater according to claim 1, further comprising a flow path forming pipe forming a flow path for gas having passed through the combustion unit, wherein gas flow speed in at least one of the combustion unit, the periphery of the combustion unit, and an inlet of the flow path forming pipe is higher than combustion speed of the combustible refrigerant.

3. An air conditioning system comprising:

a refrigeration apparatus including the refrigerant circuit filled with the combustible refrigerant; and the combustion heater according to claim 1, the combustion heater being disposed adjacent to the refrigeration apparatus.

* * * * *